US009965980B2

(12) United States Patent
López Fernández

(10) Patent No.: US 9,965,980 B2
(45) Date of Patent: May 8, 2018

(54) ADVERTISING DISPLAY

(71) Applicant: FASTER DISPLAYS LLC, Wilmington, DE (US)

(72) Inventor: Francisco López Fernández, Cornellà de Llobregat (ES)

(73) Assignee: FASTER DISPLAYS LLC, Wilmington, DE (US)

( * ) Notice: Subject to any disclaimer, the term of this patent is extended or adjusted under 35 U.S.C. 154(b) by 0 days. days.

(21) Appl. No.: 15/513,348

(22) PCT Filed: Feb. 25, 2015

(86) PCT No.: PCT/US2015/017511

§ 371 (c)(1),
(2) Date: Mar. 22, 2017

(87) PCT Pub. No.: WO2016/057067

PCT Pub. Date: Apr. 14, 2016

(65) Prior Publication Data

US 2017/0249874 A1 Aug. 31, 2017

Related U.S. Application Data

(60) Provisional application No. 62/060,646, filed on Oct. 7, 2014.

(51) Int. Cl.
*G09F 1/06* (2006.01)
*A47F 5/11* (2006.01)

(52) U.S. Cl.
CPC ..... *G09F 1/065* (2013.01); *A47F 5/114* (2013.01)

(58) Field of Classification Search
CPC ..... G09F 15/0062; G09F 15/0025; G09F 15/0068; G09F 7/18; G09F 1/06; G09F 1/08; G09F 1/04; G09F 19/10; E01F 9/012; A47F 5/112
See application file for complete search history.

(56) References Cited

U.S. PATENT DOCUMENTS 1,273,934 A * 7/1918 Horton ..... B60J 3/02 24/301
4,773,622 A 9/1988 Herlin
4,794,024 A 12/1988 Crowell et al.
(Continued)

FOREIGN PATENT DOCUMENTS

EP 2178069 A1 4/2010
FR 2795217 A1 12/2000
(Continued)

*Primary Examiner* — Cassandra H Davis
(74) *Attorney, Agent, or Firm* — McGlew and Tuttle, P.C.

(57) ABSTRACT

Deployable display with an expansion system comprising a traction elastic element. The elastic element is basically formed by an elastic band which is annular or is cord-type with engaging elements, and optionally by at least one extension for extending the length of a said band, formed by a plate made of flexible or semi-flexible sheet material provided with engaging elements for said elastic band, the assembly in turn being engaged to side projections of the display. The limiting system is implemented by the reduction in the elastic force and/or by the own resting length of the elastic band in cooperation, where appropriate, with the length of the extension element.

16 Claims, 12 Drawing Sheets

(56) References Cited

U.S. PATENT DOCUMENTS

| | | | | |
|---|---|---|---|---|
| 5,377,391 | A * | 1/1995 | Foster | A47C 21/022 24/301 |
| 5,937,553 | A | 8/1999 | Maran | |
| 6,347,772 | B1 | 2/2002 | L'Hotel | |
| 8,099,883 | B2 | 1/2012 | Mestres Armengol et al. | |
| 8,286,809 | B2 | 10/2012 | Mestres Armengol et al. | |
| 2005/0050695 | A1 * | 3/2005 | Mackey | B62J 7/08 24/300 |
| 2014/0014606 | A1 | 1/2014 | Mestres Armengol et al. | |

FOREIGN PATENT DOCUMENTS

| | | | | |
|---|---|---|---|---|
| FR | 2948222 | A1 * | 1/2011 | G09F 1/06 |
| GB | 2370977 | A | 7/2002 | |
| WO | 02095719 | A2 | 11/2002 | |
| WO | 2004027737 | A1 | 4/2004 | |
| WO | 2006037896 | A2 | 4/2006 | |
| WO | 2008148916 | A1 | 12/2008 | |
| WO | 2009125082 | A2 | 10/2009 | |
| WO | 2010/018272 | A1 | 2/2010 | |
| WO | 2010130485 | A1 | 11/2010 | |
| WO | 2011076158 | A1 | 6/2011 | |
| WO | 2012164114 | A1 | 12/2012 | |

* cited by examiner

Fig. 14A
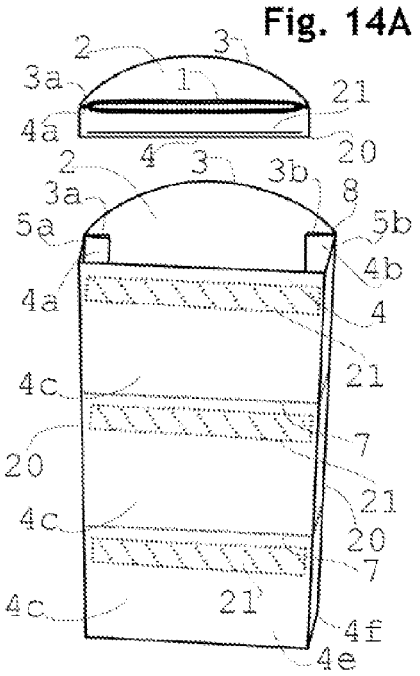
Fig. 14B
Fig. 15A
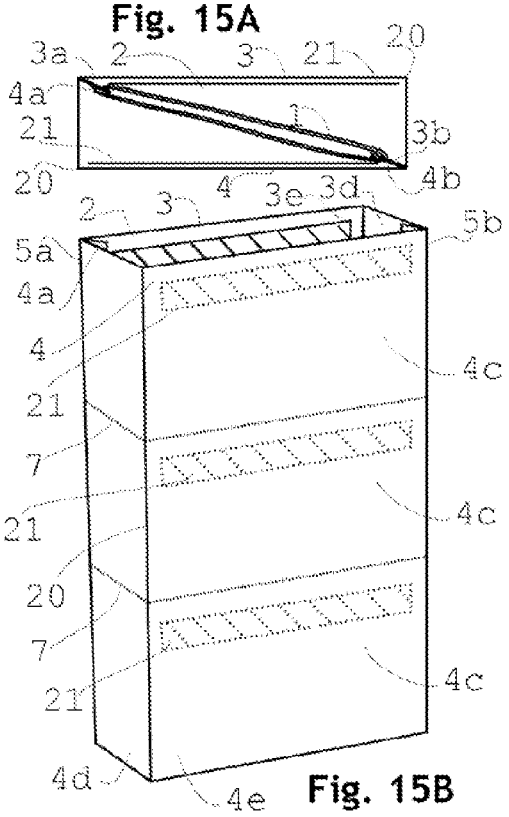
Fig. 15B
Fig. 16A
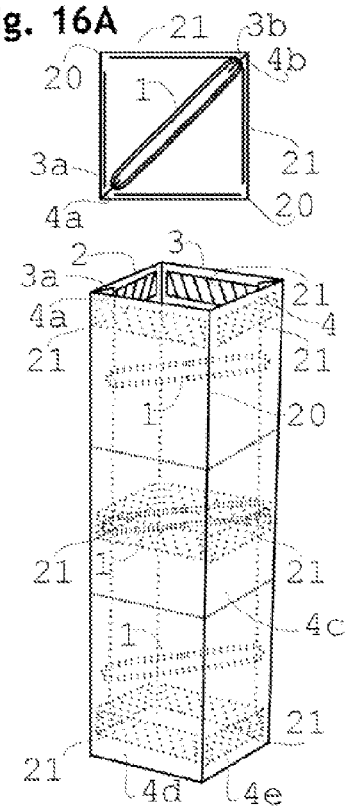
Fig. 16B
Fig. 17A
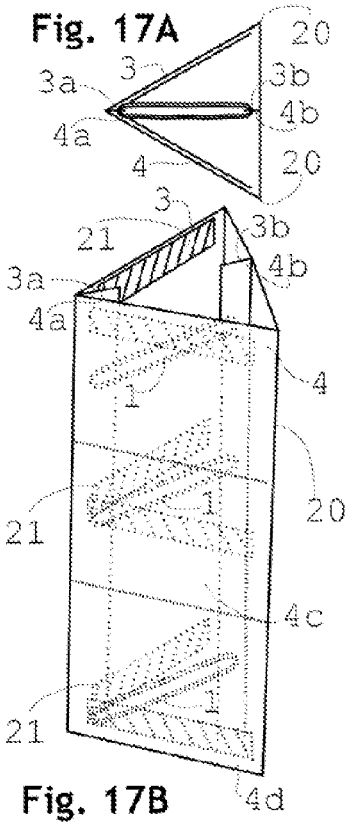
Fig. 17B 4e
4
101a
103b
108
20
101
15
103a
3b
6
3
103
103a
4d
3d
103
104
109
102
107
1
109
104
16
101
101a
101b
20
3a
105
3e
106
101c
4e
2
103
102
20
1
101
101a
4d
101
103c
103b
103c
101b
101a
101c
101a
4e
103b
101
4d
4e
101
4d

ADVERTISING DISPLAY

The present invention relates to a display with an expansion system thereof, the display preferably being a folded structure made with semi-flexible sheet material, particularly of the type in the form of a column, cylinder, prism, cone, pyramid, cube, etc., usually manufactured with paperboard, cardboard or a similar material, for the purpose of displaying an advertising message.

Such display structures are transported in the folded or flattened position and are semi-automatically deployed at the place of sale or place of display through the expansion system consisting of a contraction mechanism containing an elastic element and a limiting mechanism to limit the said contraction.

Expansion of the display is generally referred to when the system actually works as a result of the contraction of a previously stretched element. The system contracts certain end parts of the display with the effect of causing bulging or expansion of the central zones thereof. However, expansion system of the display shall generally be referred to because it is the final effect that really matters in keeping the display upright.

Different expansion systems of displays are known. They all consist of expansion systems formed by two members that are essential from the functional point of view, namely, a contraction member, and a limiting member for limiting said contraction.

In all the mentioned background, both members are implemented by clearly different physical elements and formed by means of panels or edges cooperating in the process of expansion of the display, some of which come into contact with one another and work as a stop or a limitation of said process. The mentioned contraction member always incorporates one or several elastic elements acting such as to provide the contraction force.

WO2006037896A2 discloses a tubular-type folding display having an oval section, formed by two flexible panels facing one another back to back and supported by side projections of the same panels by way of tabs folded inwardly by means of vertical creasing lines. The display is self-expanding by means of a system based on the contraction of the side edges, causing the bulging of the front and rear panels, which are initially in a flattened configuration, resulting in a widened structure that can keep itself upright. The complete expansion system of the display is formed by several traction units which can be repeated once or several times along the vertical structure of the display, each of said units consisting of two annular elastic bands, each of which is linked to said side tabs of the panels of the display. Each of said elastic bands is also coupled to one side and the other side, respectively, of an intermediate separating plate made of rigid sheet material having a certain side profile shape with the edge lines or edges of which coming into contact with the inside of the side edges of the display, stopping and limiting the contraction travel produced by the elastic bands. In situation in which the display is expanded, the elastic bands continue to be stretched, the travel thereof having been limited by the rigid intermediate plate. The final result is a display with a well-calculated expansion determined by the side length of said intermediate plate. It must be pointed out that in the operating principle thereof, the role of the dimensions of the intermediate separating plate which limits expansion is basic, thus each type of display requires different separating plates with different dimensions. In addition, the elastic bands in said system are stretched at a specific length by the limiter and not by the natural length of the band, and at no time they reach the resting position in which the tension of the band is nil. One drawback of an elastic band being permanently stretched is that it accelerates temporary degradation of the elastic properties, with the subsequent loss of force and premature decomposition of the material.

WO02095719A2 discloses a self-expanding foldable display comprising a display panel made of sheet material, expansion means for curving the display surface of the panels, and supporting and limiting means for supporting and limiting expansion, to keep the display surface in the bulged position, where said supporting and limiting means counteract the tension of the elastic elements. Said supporting means are repeated several times throughout the structure of the display to homogenously distribute the expansion force throughout same. This system is similar to the system disclosed in WO2006037896A2 mentioned in the preceding paragraph. One of the main differences in this case is based on the fact that the expander uses a single elastic band at one of the ends of the support element, whereas at the other end, the intermediate separating plate is fastened to the side of the display panel by means of projections with a hook provided at the support element which are coupled in grooves performed in the side projection of the display panel on the rear face thereof, said intermediate separating plate acting as a limiter of the contraction.

U.S. Pat. No. 6,347,772B1 discloses a self-expanding display, where the two main display faces are formed from a single sheet divided into two main faces by means of a vertical folding line. Tabs having engaging elements for an elastic band and separation elements in turn forming engaging elements for the elastic band at an opposite end are also formed on the same main sheet. When the traction system is actuated, in a preferred embodiment, the display has a main face with an oval convex shape, whereas the opposite face forms a flattened surface, although this last face leaves parts of the traction mechanism visible, and therefore it is not useful for advertising purposes due to aesthetic reasons. The system uses the inner panels where the elastic band is linked as limiters for limiting the contraction.

FR2795217A1 discloses an expansion system similar to that described above, with the exception that in this patent the system has a prismatic triangular structure.

WO2009125082A2 relates to an information display having two positions: a flattened position and an expanded position, formed by a sleeve made of semi-rigid material comprising at least two side longitudinal folding lines for folding said sleeve, said folding lines defining two display surfaces, and further comprising means for keeping the display expanded in the working position. Said expansion means comprise at least one elastic tie attracting said side folding lines to one another and an intermediate spacer inside said sleeve, having terminal ends for limiting the separation, and means for engaging said elastic bands which in turn are interlocked with said spacer, such as to fasten it and collaborate in the tension of said bands.

WO2011076158A1 also relates to a display capable of adopting a flattened position and then adopting another working position in which the display is bulged and upright as a result of the action of traction means causing the expansion. The display is constructed from two cutouts rigidly connected by means of facing tabs which are glued to one another, and also from separation panels formed by a projection of the main panels, and bearing elastic traction means causing the sides to be attracted to one another and thus the bulging of the faces of the display. The separation panels determine the limit travel of the attraction means for causing the desired curvature, similarly to the aforementioned background.

EP2178069A1 has a traction system for expanding displays which is based on a mechanism formed from a rigid panel having certain folding lines in a central region, such that when folded along said lines a configuration with a smaller side length of said panel is achieved, and further engaging elements for one or two elastic bands are formed. The panel has side ends which are assembled on inner ends of the display, and the length of the panel is reduced by means of the action of the elastic bands, such reduction being limited by the system of folds which makes some rigid surfaces come into contact, determining the maximum contraction travel and therefore the expansion of the display.

WO2012164114A1 discloses a side support for a rigid display including a structure consisting of several panels made of sheet material connected to one another by folding lines, including a panel fastened to the display and one or several support panels. The structure can adopt a flattened configuration together with the display and adopt another expanded or working configuration, in which a pyramidal structure is formed, being aided by traction means formed on the inside thereof. The inner elements comprise, in addition to an elastic band, limiting panels for limiting contraction, which in turn form hooks for linking the elastic band. The main application of the device is to serve as a support for a display, not as a display itself. It also uses a rigid stop to limit expansion.

WO2010130485A1 discloses a display which is basically formed by two facing display panels internally housing therein a plurality of expansion systems for expanding said panels from a flattened configuration to another expanded configuration. In this case, expansion takes place not because of a traction system of the ends by means of an elastic band, but rather by means of spring-like compression devices located transversely between both panels which are compressed in the flattened position and produce a recovery force which thrusts both panels in the opposite direction towards the expanded position. When the forces keeping the display in flattened position are released, the main panels bulge out to the working configuration. This expansion system is based on the thrusting or direct expansion of the main panels, unlike other systems based on traction, such as the present invention.

WO2008148916A1 discloses an expanding device made from two cross-linked laminar bodies of a rigid material such as paperboard, applied for expanding a self-expanding foldable display made up of two facing panels connected by their side edges, and that in a collapsed position they adopt a flattened configuration, and in a service position they adopt a three-dimensional configuration capable of staying upright. This system is of the type based on the thrusting the main panels and the traction of an elastic element.

WO2004027737A1, U.S. Pat. No. 5,937,553A, U.S. Pat. No. 4,794,024A and U.S. Pat. No. 4,773,622A disclose polyhedral displays expanding automatically from a flattened configuration to a three-dimensional configuration due to the traction action of an annular elastic band. Given the shape of the display, the travel is limited by the contact between edges of the faces forming the display, said edges acting as a rigid limiting system in the form of a stop, the elastic band being stretched in the configuration.

GB2370977A discloses a square prismatic display which is deployed by the traction effect of a band placed in hanging arrangement between two opposite faces of the prism. The system comprises a mechanical stop formed by bent flanges connected to one another and connecting contiguous opposite walls to the walls from which the elastic band hangs, thus forming a body transverse to the vertical axis of the display and parallel to the action of the bands, forming a stop or limiter stopping or limiting the contraction travel of the metallic band preventing the walls from getting any closer than the designed distance or else preventing them from being folded in the form of an accordion.

WO2010/018272A1 discloses a thrusting device for displays comprising two or more plates made of a sheet of cardboard or another similar material in cooperation with one or more elastic traction elements, which can be applied to keep the displays upright or to expand them.

The minimum length of the elastic band is determined by the distance between the receivers of the end of the rubber band of each sheet of paperboard, the rubber band being placed in a previously extended position, i.e., with a length exceeding its natural length, between two receivers of each of the sheets of paperboard.

All the aforementioned background, which have been known for over 4 decades, have some type of limiter for limiting the travel and stop. This makes it necessary to have different types of limiters for each type of display.

The present invention provides an improvement in terms of simplicity and therefore originality, achieving important advantages with respect to the background previously described, maintaining the same functionality and efficacy. The simplicity in manufacture provides it with a great advantage associated with manufacturing costs which give it a clear edge with respect to other systems having the same functionality.

The present invention proposes a minimalist system formed from a suitably configured single element which alone encompasses both functionalities, i.e., contraction and limitation of contraction, providing a great simplification throughout the entire manufacturing and production process.

The expansion system applied to a display to which the present invention relates comprises a traction element, which can be a single one and is formed by an elastic band in one embodiment, with the feature of having a "resting length" adjusted to a suitable value for achieving the desired level of expansion in the display containing it. The system acts by attracting mutually facing zones to one another. The mutually facing zones can correspond with edges or folding lines of the sheet material forming of the display, thus accordingly causing a bulging of the semi-flexible central zones of the display until reaching an upright working position. Preferably, engaging elements or hooks for the elastic band, performed in tabs associated with said side edges can collaborate for such purpose.

More specifically, the present invention solves the aforementioned problems by means of an advertising display comprising at least two panels made of sheet material, having side projections connected thereto on the hinge or folding lines performed in said panels; an expansion system for bringing said display from a flattened position to an expanded or working position, comprising at least one traction elastic band; said display further comprising hooks or engaging elements for connecting said side projections with said expansion system; and said display lacking additional limiting devices defining a stop relative to the contraction travel of said elastic band, such that the end of the contraction travel of said elastic band is defined by the reduction of the contraction force of said band during contraction.

More preferably, the dimensions of said display in expanded position are determined by the resting length characteristic of said at least one traction elastic band.

More preferably, the at least one elastic band is hung from two ends, being supported at the points in which said at least one elastic band is hung and without any support or guide in at least one intermediate part between supports.

More preferably, the expansion system comprises at least one extension element, said at least one extension element comprising coupling means for said elastic band at one end and connecting means at the other end thereof for connecting to said side projections of said display.

More preferably, the extension element comprises a plurality of coupling means for said elastic band located at different points of said extension element for defining different lengths of said expansion system.

More preferably, the expansion system comprises two elastic bands connected to one another through said extension element between bands having at least one of said coupling means for each of said bands at each end of said extension element.

More preferably, the extension element between the bands comprises in at least one of its two ends at least two coupling means for each of the bands, such that the resting length of the assembly formed by the extension element and the two bands can be modified, each one being connected to an end of the extension element between bands.

More preferably, said extension element is made of flexible plastic so that the element is also flexible.

More preferably, said elastic band is of an annular type.

More preferably, said elastic band is of a linear type with two opposite ends, and each of said ends is integrally connected to a hook- or clamp-like engaging element made of metal, plastic or another material, and said engaging elements allowing said ends of the elastic element to be engaged to said side projections of said display.

More preferably, the display comprises two message display panels of the same width, made of flexible sheet material; a plurality of side projections connected thereto on hinge or folding lines performed in said panels by creasing lines in the sheet material of said panels, such that when said side projections are folded inwardly by means of said hinge lines, side edges are formed in the display; connecting means, such as glue or elastic bands, are provided between opposite side projections and of the panels of the display for keeping said opposite side projections and united to one another; and in that engaging means are performed in said side projections such that said elastic bands of said expansion system or the extensions are to be linked through said coupling means of said extensions, or the engaging elements.

More preferably, said main panels of said display have a plurality of horizontal lines formed by creasing lines dividing each of said panels into substantially rectangular portions, allowing said panels to be fold along said lines when the display is compressed to said flattened configuration, thus achieving a smaller folded assembly.

Preferably two symmetrical elements made of substantially rigid, corrugated paperboard-type sheet material, are coupled by means of elastic bands or by means of gluing to facing side projections of the main panels corresponding to the lower zone of said display, on both sides of said display, each of said symmetrical elements being formed by two substantially rectangular or polygonal hinged regions hinged by means of a vertical fulcrum line, where a first region is housed in coplanar form between said side projection of the main panel and said panel, said fulcrum line parallel corresponding with the inside of said side edge of the display, whereas a second region extends towards the inside of said display a certain length equivalent to the width thereof; and in that said second region further has a hole or hook close to the lower edge thereof, suitable for fastening or linking an elastic band therein; and further characterized in that it comprises a rigid platform-like third part having die-cut therein, two hooks for said elastic band which is linked to the second region of said two symmetrical elements, said rigid platform-like third part being pressed against the base of the display as a result of the tension of said elastic band.

Preferably said main panels of the display are provided as two separate parts that must be connected to one another, for which the upper part has in the lower line thereof regularly distributed projections narrowing slightly towards the lower end, where two of said projections are narrow enough and are included in the side projection portion of the corresponding panel; and in that the second part has cuts-grooves, each of them corresponding to a projection of the first part; and in that said projections of the first part fit perfectly with the grooves of the second part along a straight stop line; and in that elastic bands hold to the side projections provide stability and fastening of the assembly.

Preferably, the display comprises a substantially rectangular flat panel made generally of a cardboard-type material, divided into five regions defined by folding lines, and an integral rectangular panel; and in that said panel is formed by placing glue in two alternating regions of said five regions, adjacent to the central region and folding along the lines until the glue comes into contact with the central region; and furthermore the panel is added by gluing along the central region on the same gluing face previously used.

It must be stressed that even though in the case of using an extension or an element for prolonging the elastic band such as will be explained herein, said element can preferably be of substantially flexible nature with the sole function of linking an elastic band, in contrast with the rigid element acting as a limiter or stop incorporated in some of the mentioned devices.

An important original feature of the present invention is based on taking advantage of the "resting length" of the elastic elements to turn it into an element determining the basic operation of the expansion system. The present invention is based on using said property to implement the limiting element for limiting expansion of the display in a natural manner, lacking other physical elements intended for limiting contraction of the elastic traction element.

According to the present invention, the resting length position of the elastic band determines the expanded position of the display. Therefore, said resting length determines the maximum level of expansion of the display. In contrast, when the display is in the flattened position, i.e., in the folded position, the elastic band is elongated to a maximum length, therefore being subjected to tension and applying a contraction or tensile force in a constant manner tending to deploy the display and bringing the same to a working or expanded position as soon as the forces keeping it in said flattened position are released.

The end point of the contraction travel based on a reduction in contraction force corresponding to the resting length represents what could be referred to as a "soft limiting system". Due to the nonexistence of a stop, the position of the travel limit, in practice, is not a locked position such as that which can be obtained with other systems using a rigid limiting element, such as a piece of paperboard, which establishes the contraction travel of the elastic band with a high degree of accuracy. The "soft limitation" system such as the one described herein does not establish a contraction limit with respect to the length by means of a mechanical stop. However, the type of displays which are presented as applications of the expansion system of the invention generally allow a small margin of inaccuracy in the order of a few millimeters and even a centimeter in many cases. By playing around with that tolerance range and the capacity of adjusting the characteristics of the expansion system, the advantage of being able to perfectly apply our system is achieved and thereby benefiting from the simplification. These considerations are just some of those causing the application of this invention being non-obvious up until now and justifying not having been used in any of the known background.

According to the present invention, the elastic band provides the mechanical tension necessary for creating the force attracting the mentioned side edges to one another. Coupling elements which are preferably integral with the mentioned side edges or folding lines of the display can be formed in the display to which the expansion system is applied, to allow fastening the elastic band or possible elements for aiding in said fastening.

The resting length is a feature that is inherent to elastic elements in general. Said elements do not exert an external force when they are in the resting length position. When an elastic element is deformed generally by elongating or contracting its length, it then shows a force that is substantially proportional to the deformation which tends to take the system to its original position.

The section of the elastic band and the elongation from the resting length will determine the force that will intervene in the expansion of the display, particularly, it will be the force attracting the mentioned side edges of the display to one another. If the elongation or increase in length of the elastic band between the resting position and the extended position is $\Delta L$, then the force applied by the elastic band while it is maintained in said extended position is $F=K\times\Delta L$, K being the elastic modulus of the elastic band, which modulus depends on the type of material, the resting length and the section of said elastic band. The elastic band can be made in different sections and lengths, and therefore the desired expansion and expansion force values can be obtained by adjusting said length and section parameters of the elastic band without needing to add new physical limiting elements for limiting the travel of said elastic band.

In a basic embodiment, the expansion system consists simply of an annular elastic band which can be engaged directly to hooks or grooves performed in side projections of the display, said projections being linked directly to the side edges of the display, and said elastic band having a resting length suitably adjusted for obtaining the desired level of expansion.

According to a preferred embodiment of the invention, said elastic band is of a linear or cord type. Such band needs engaging elements made of metal, plastic, or of another material, hook- or clamp-like shaped, integral with the ends thereof which allow linking the ends of the elastic band to side projections of the display by means of a hole made in said projections, for example. In some cases, this system could simplify the manufacturing process.

In practice, the characteristics of the available elastic band commonly do not correspond with the optimal values necessary for achieving the desired level of expansion in a specific display. The present invention envisages a further feature for solving the problem according to which, in addition to the mentioned elastic band, the expansion system comprises an auxiliary extension element consisting of a band made of flexible or semi-flexible sheet material that is not necessarily rigid which forms at least one coupling for the elastic band at one end and one coupling for one of the side edges of the display at the other. As a result of this auxiliary extension element it is possible to prolong the effective resting length of the expansion system, being it formed by the elastic band and the extension element, and the tensile force in the initial expansion position can also be adjusted when the elastic band is extended. If said auxiliary element has several hooks formed for the elastic band located at different distances, the most suitable length can be selected at the time of use according to the desired level of expansion depending on the type of display.

In a variant of the preceding system, the elastic band is connected to two extension elements, one on each side, in a symmetrical manner. The resulting assembly has a longitudinal arrangement following the "extension element"–"band"–"extension element" order, the coupling members which will allow fastening to the side edges being located at both ends. The usefulness of this embodiment resides in its capacity to obtain operating lengths several times longer than that of the elastic band itself, and it is also useful for facilitating coupling with side edges, in addition to the advantages characteristic of the shape expressed in the preceding paragraph.

The mentioned extension or element for prolonging the elastic band can have a coupling member at one of its ends, such that it is suitable for being engaged both to a side projection of the main panels and to an elastic band. It is therefore possible to link the corresponding elastic bands, one on each side of said extension element. Therefore it is also provided another possibility of playing around with the length and elastic modulus of the system based on a single extension element to enable adaption to a wide range of display sizes and types.

It can be readily demonstrated that the "elastic band"+ "extension element" assembly is equivalent to a single elastic band with the same value for the elastic modulus K and a longer resting length, which would be achieved with a band having a larger section and longer length; therefore, the use of such extensions offers savings in elastic material, in addition to how easy it is to adjust the elastic characteristics of the system.

The present invention also discloses different displays based on the expansion system object of the present invention.

One display shape according to the present invention corresponds to an oval column-type display consisting of two main message display panels made of sheet material, preferably a semi-flexible cardboard-type material or the like, in which several side projections are formed by a projection of side portions of said main panels, said projections being linked to the side panels by means of hinge lines formed by creasing lines in the sheet material forming said panels, such that when said projections are folded inwardly by means of said hinge lines, side edges are formed inside the display. There are also connecting or linking means, such as glue or elastic bands, for example, for connecting opposite projections of the panels of the display in order to keep them connected to one another. The side edges furthermore have engaging means in the form of grooves or hooks, generally formed by die-cutting, where the elastic bands of the expansion means or the mentioned extensions of the elastic bands will be linked.

According to another preferred embodiment, the display has one or several vertical creasing lines performed in its main panels, such panels being divided into several regions susceptible to turning relative to the others through said hinge creasings. When the display is in the working configuration, it shows different surfaces in the form of a column so the assembly adopts a prismatic shape. Said prismatic shape can adopt a square section, rectangular section, rhombus section, hexagonal section, triangular section, etc., depending on the relative values of the widths between creasing lines, distances between the same, number of creasings and adjustment of the expansion system.

Another aspect relating to displays containing vertical creasing lines, which can be considered a particular case of displays with a prismatic shape, discloses a display with a vertical creasing in each of the main panels, such that the distance from the creasing to the edge of one end in a first panel is twice the distance with respect to the other end, whereas in the second panel of the display the distance relationship of the vertical creasing is exactly the opposite. When the display adopts the working or expanded configuration, the intention is for the two narrowest columns, one from each main panel, are aligned, i.e., coplanar, forming a single effective surface between both. In this situation, the display shows a prism configuration having a substantially isosceles triangular section.

Also in another aspect relating to displays containing vertical creasing lines, the display has regions obtained by the projection of the ends of the main panels for forming, among others, covers closing said ends for achieving a parallelepiped, and particularly a cubic structure. As a result of the features of the invention, this display assembly is furthermore susceptible to being folded entirely to the level consisting of a single face, first folding the side covers by folding them backwards, flattening the rest until it is folded to the level consisting of two faces of the parallelepiped, and finally folding along the central line separating the two faces until being at a level of folding consisting of a single face where all the mentioned regions of the main panels are folded and arranged on top of one another.

In another aspect relating to displays containing vertical creasing lines a display is disclosed where two vertical creasings have been performed in a first main panel of those panels forming said display, whereas the second panel has no vertical creasing. When the display adopts the working configuration, the first panel shows three different, substantially flat surfaces, depending on the rigidity of the material, whereas the second panel is forced to curve or bulge out, finally being a display showing two faces having different shapes, one being substantially prismatic with three columns, and another one being curved and having an oval section. If the two end columns formed in the first panel are substantially narrower than the central column, one face of the display corresponding to the first panel will have a surface with a flattened configuration, whereas the opposite face will have a convex surface.

The present invention also discloses a type of display formed by two main panels as described in the display referred to as basic, with the particularity that in the lower region the width of the panels is greater than the width thereof in the upper part, changing the width proportionally according to height. With this configuration, when the display adopts the working position it adopts a substantially conical shape.

According to another feature of the described displays, the present invention discloses a variant of the prismatic display in which the main panels forming it have in a lower region a greater width than the width thereof in the upper part, changing the width proportionally according to height. With this configuration, when the display adopts the working position it adopts a substantially pyramidal or truncated pyramid shape.

In another aspect of the invention, each of the main panels of the display has two vertical creasings along a broken or curved line, changing the distance of each segment of the line with respect to the closest side edge of the display depending on height. Each panel of the display is divided into three vertical regions having width that is variable by segments and hinged to one another turning along said creasing when the display adopts the working arrangement. The display in the working position therefore acquires an irregular prismatic structure, which could be appealing as an advertising ploy. It is particularly desirable to adjust the characteristic resting length of the expansion system to such a value that the two contiguous side column surfaces of both panels are in a coplanar position, forming a single effective surface along the side of the display, divided by a vertical central line corresponding to the line joining the two main panels.

One variant of the invention discloses a display where each of the main panels has two vertical creasing lines, the distance of each creasing with respect to the closest side edge of the corresponding panel being the same and this distance being substantially shorter than the width of the central region; and the two central regions, corresponding to the two main panels, have discrete regions for gluing on the facing inner surfaces along a central vertical line for preventing the bulging of said central zone, without preventing the passage of an elastic band through the inner surfaces to enable housing the expansion system. When the display adopts the working configuration, it adopts a column shape with two concave surfaces in the front and rear zones.

According to another aspect of the present invention, the main panels of the display have a plurality of folds marked by creasings, in different directions, forming edges and vertices, and surfaces therebetween. When the display adopts the expanded configuration, the surfaces turn relative to one another by means of the folding lines, forming different angles, for adapting to a possible bulged configuration. The final structure adopts polyhedral shapes similar to a mosaic structure, which can be appealing for advertising purposes.

According to another feature of the invention, the display has main panels having two vertical creasing lines each forming a substantially rectangular surface therebetween, while at the same time said main panels are wider at the base than in the upper line, and furthermore the vertical creasing start from the upper vertices and descend in a substantially vertical fashion, further defining substantially triangular identified side surfaces. When the display adopts the expanded configuration, the surfaces turn relative to one another by means of the folding lines, forming different angles giving rise to a final structure adopting a tent shape, i.e., two substantially rectangular surfaces in the main front and rear views, and two substantially triangular surfaces on the sides.

Based on another feature of the display, said display is formed by two main panels each having a vertical creasing dividing them into two column regions. In each panel, the two regions are folded one over the other by turning along said vertical creasing line, being arranged back to back. The two panels are assembled such that both are opposing, maintaining the position in which the two column surfaces of each panel described above are folded with the inner surfaces facing one another. The vertical creasings form the outermost edges of the display both in the folded position and in the working position. When adopting the expanded configuration, the display shows two views, each of which shows two surfaces, a flat surface and another bulged surface.

Based on the described types of display, and virtually any version thereof, a counter can be formed that is capable of supporting generally commercial products, so said product has applications that are appealing for advertising purposes. Such objective is achieved by adding a plate made of rigid sheet material which will act as a board; it also comprises a part generally made of paperboard or the like with a substantially rectangular shape, having several hinged regions defined by creasings, the role of said part being to assemble the board in the corresponding display in an hinged manner and allowing folding the entire assembly into a flattened structure.

Based on the described types of display, and virtually any version thereof, the feature of the main panels having a curved cut line at its base can be carried out. This offers certain instability to the working balance of the display in the expanded configuration, meaning that the most minor mechanical perturbation, such as an air stream, can cause a swiveling movement. This display could be useful effect of attracting attention to an advertising message.

In another aspect of the displays being described, the main panels have a hook-shaped die-cut profile at the ends, or they project forming a hook at each of its ends, whereby the display is capable of being coupled on both sides to the upper edges of two conventional displays working as columns, while the former works as an arch or roof. This feature allows forming arch- or goal-type structures from displays of different types. The functionality of this structure can be increased by simply adding a display in the form of a rectangular prism of the type described herein, but in the horizontal position supported on the ground and adjusted between columns, an arch structure including a counter for displaying or dispensing products, can be obtained.

According to an advantageous feature of the invention, by means of the side assembly of two or more displays using elastic bands coupled to side projections of the panels of the display for keeping the side edges forming folding screen- or partition-type structures connected, attaining large viewing surfaces.

The displays object of the present invention can contain a plurality of horizontal folds in the main panels, located at different heights, such that once the walls of the panels forming the display are flattened, the entire assembly can be folded through said folds in the form of a zigzag or an accordion, the assembly taking up a smaller volume.

The displays of the invention can be constructed with graphic sheet material with poor rigidity. This hinders the presentation of flat surfaces in some cases because they tend to curve as a result of the mechanical tensions occurring in the process of expanding the display. To solve this problem, embodiments are proposed in which plates made of a rigid material, such as corrugated paperboard, glued or adhered to one another on the inner face of said panels to provide them with rigidity and to get them to stay flat in the expanded display configuration, are added in certain regions of the panels forming the display.

Based on any one display described above it is possible to form a leaflet pocket by means of a panel, made of a semi-flexible material which can be of the same type as that used for forming the display itself, having four projections, with symmetry in a vertical axis, and which are introduced through grooves or cuts made in a region of one of the main panels of the display. The assembly is interlocked and remains flattened until the user lightly pulls on the central zone of the panel, provided it with a pocket-like bulged shape capable of holding a set of advertising or informative leaflets; while at the same time, an edge capable of working as a stop in the rear part of the main panel is formed in each of the upper projections of said part, preventing the part from being completely extracted when the user pulls on it for forming it.

A preferred additional embodiment of the invention allows providing the display with a complementary rigid platform-like part which is connected to the display at the base thereof and allows the assembly to be hinged perfectly with the display in both the flat position and extended position, in which it provides stability and anti-tipping support for the display. For connecting thereof to the base of the display, there are further arranged two symmetrical elements formed by substantially rigid, corrugated paperboard-type, sheet material on both sides of the inside of the display, each of them formed by two substantially rectangular or polygonal hinged regions hinged by means of a vertical fulcrum line, where the first region is housed in coplanar form between the side projection of the main panel of the display and the panel itself, the fulcrum line corresponding in parallel with the inside of the side edge of the display, whereas the second region extends towards the inside of the display a certain length equivalent to the width thereof, said region furthermore having a hole or hook close to the lower edge and a certain distance from the side edge, capable of fastening or linking with an elastic band which will allow the connection between said part and the rigid platform where the corresponding hooks for said elastic band will have been previously die-cut.

In large displays the main panels of the display are usually in two smaller parts that must be connected to one another, generally by gluing. As an added feature of the present invention, a method for assembling both parts without using said glue is proposed. For such purpose, the upper part of the panel has in the lower line thereof regularly distributed projections narrowing slightly towards the lower end, where two of said projections are narrow enough and are included in the side projection portion of the corresponding panel; and on the other hand, the second part has cuts-grooves, each of them corresponding to a projection of the first part; and furthermore said projections of the first part fit perfectly with the grooves of the second part along a straight stop line; being provided corresponding elastic bands hold to the side projections for providing stability and fastening of the panel which will subsequently be incorporated in one of the possible displays described.

The type of displays described can be complemented with an upper bracket- or lid-type finish. This element increases the message display surface and improves the aesthetic appearance of the corresponding display. The present invention provides a simplified advertising lid for being placed on said displays. It consists of a single part or substantially rectangular flat panel, generally made of the same material as the display, divided into four regions defined by folding lines. The end regions are somewhat shorter than the central regions. The panel is manually folded along these latter regions to give shape to the part, and it must then be inserted into the display.

Finally, the invention also provides the embodiment of a type of tray with a semiautomatic rail that is easy to make from rigid paperboard which, once formed, can be inserted into openings made in the display and intended for such purpose. Said tray is formed from a substantially rectangular flat panel divided into five regions defined by parallel folding lines, two of which are suitably glued together. An integral rectangular panel is also added by gluing it along the central region. The end user must fold the end regions towards the inside of the assembly to an angle greater than 90° so that the ends of the integral panel are locked, keeping the end regions at a fixed angle of 90°, forming rails for holding the product to be supported.

To better understand the invention, drawings of an embodiment of the present invention are connected by way of illustrative, non-limiting example.

Figure 4A:
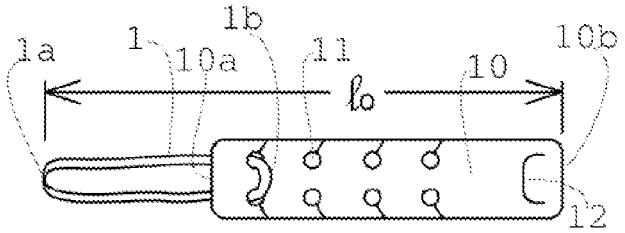
Figure 4B:
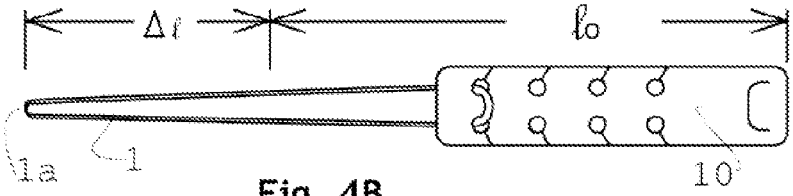
Figure 5:
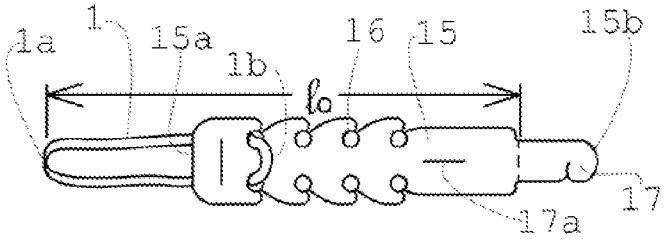
Figure 6:
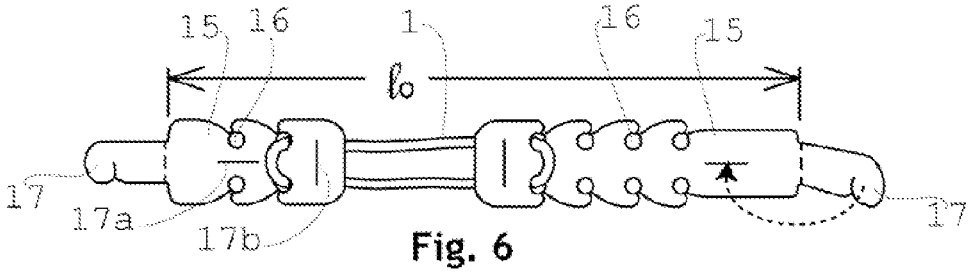
Figure 7:
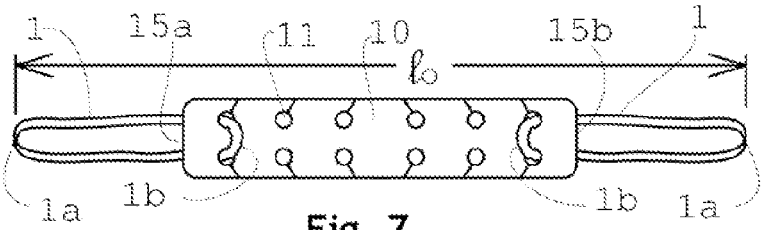
Figure 8:
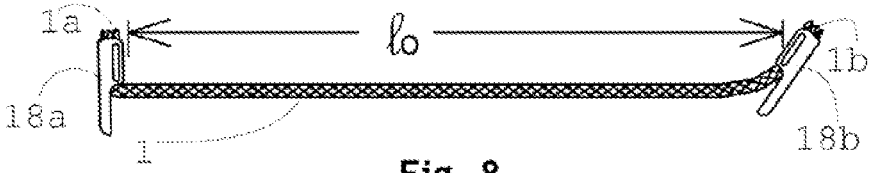
Figure 13:
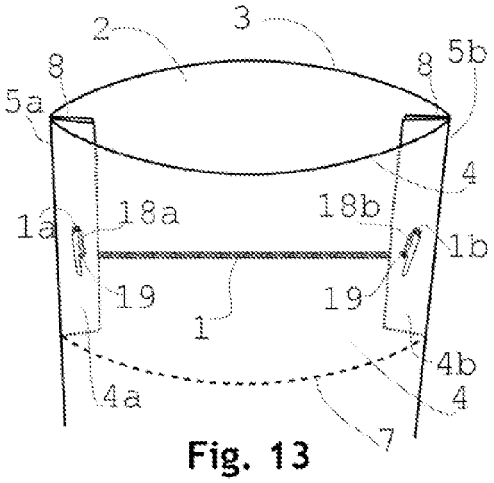
Figure 18A:
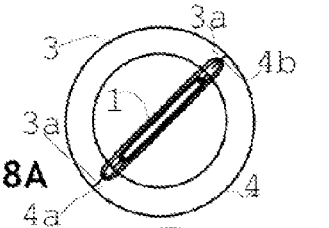
Figure 18B:
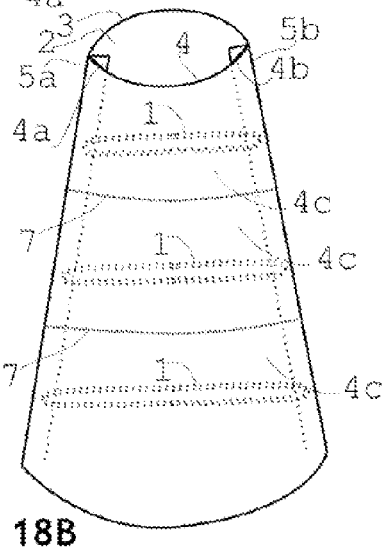
Figure 19A:
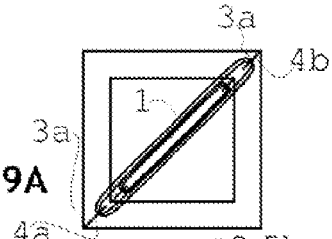
Figure 19B:
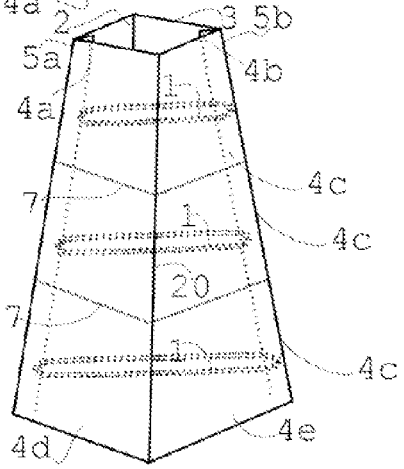
Figure 22A:
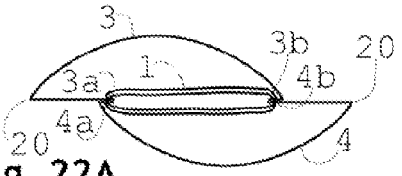
Figure 22B:
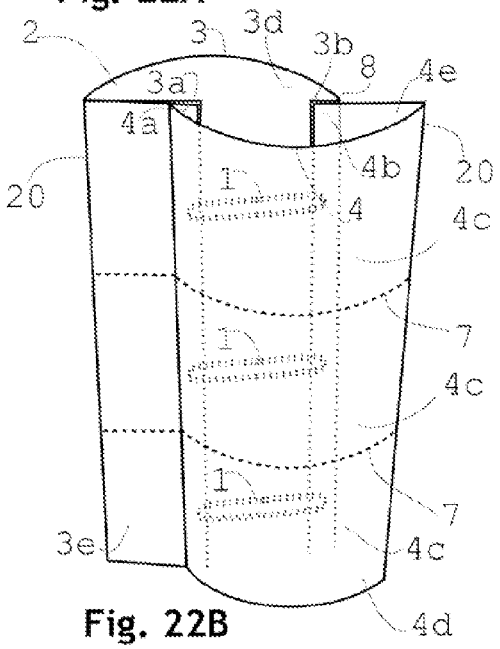
Figure 23:
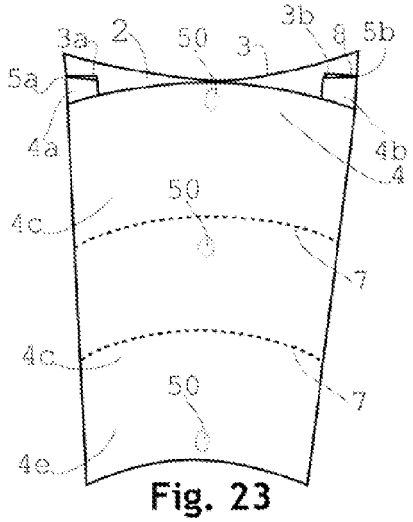
Figure 24:
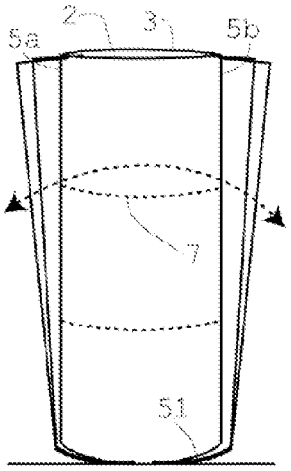
Figure 25:
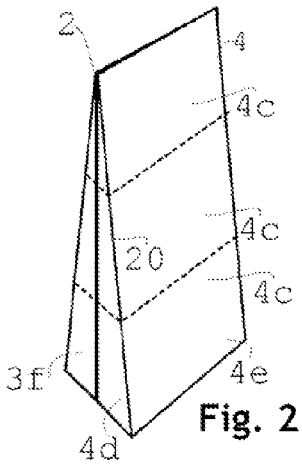
Figure 28:
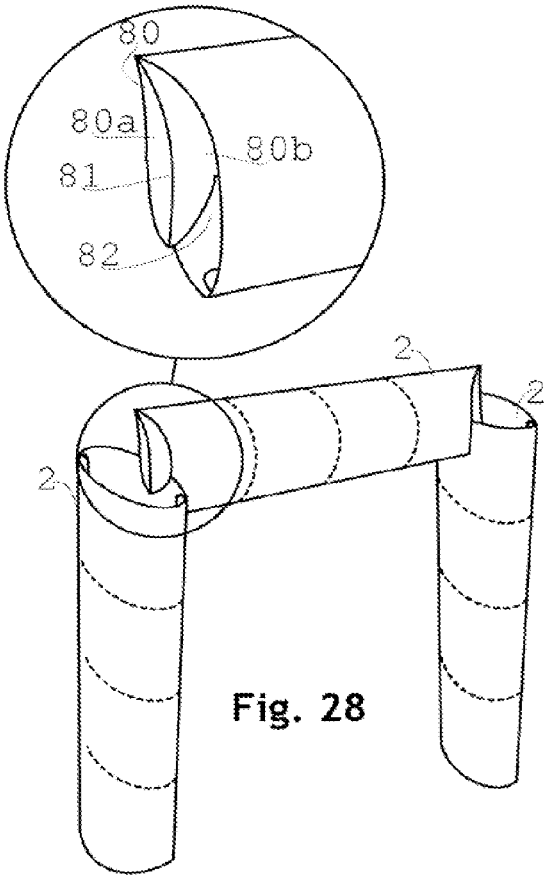
Figure 29:
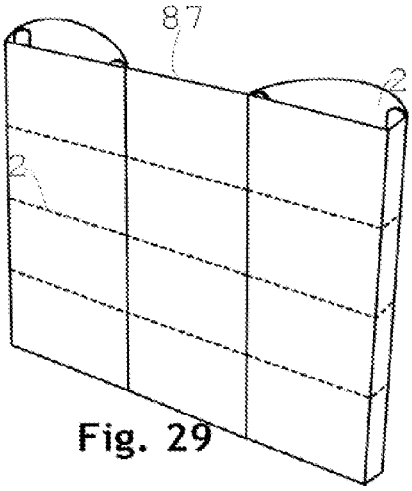
Figure 31A:
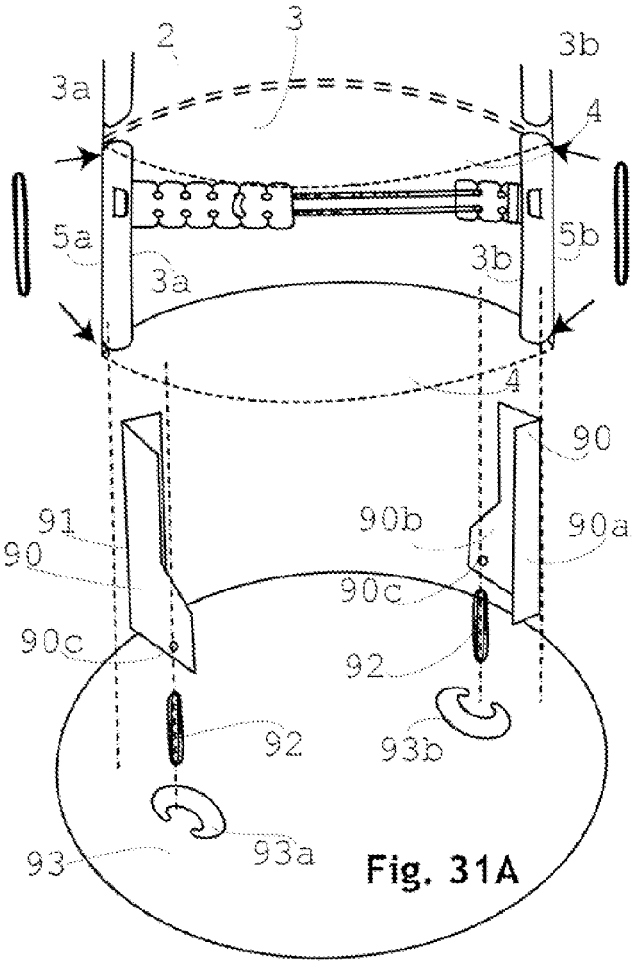
Figure 31B:
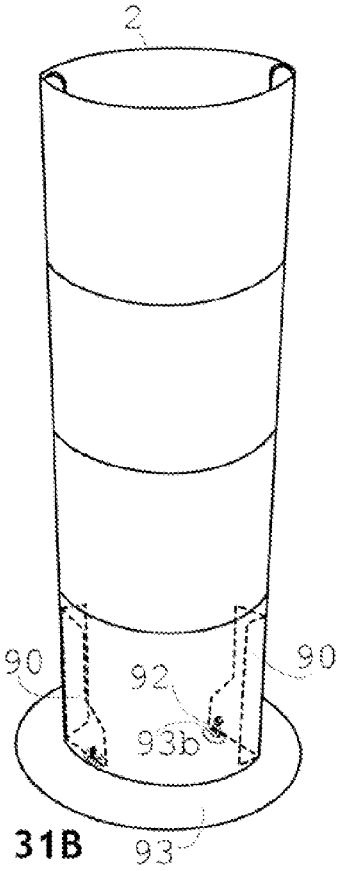
Figure 32A:
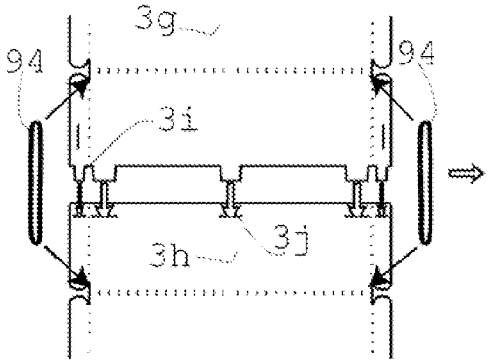
Figure 32B:
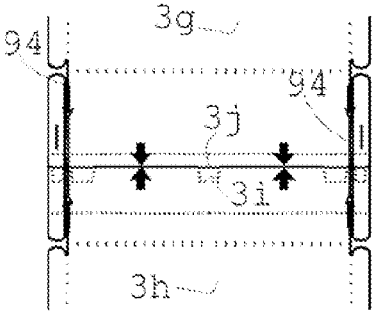
Figure 33:
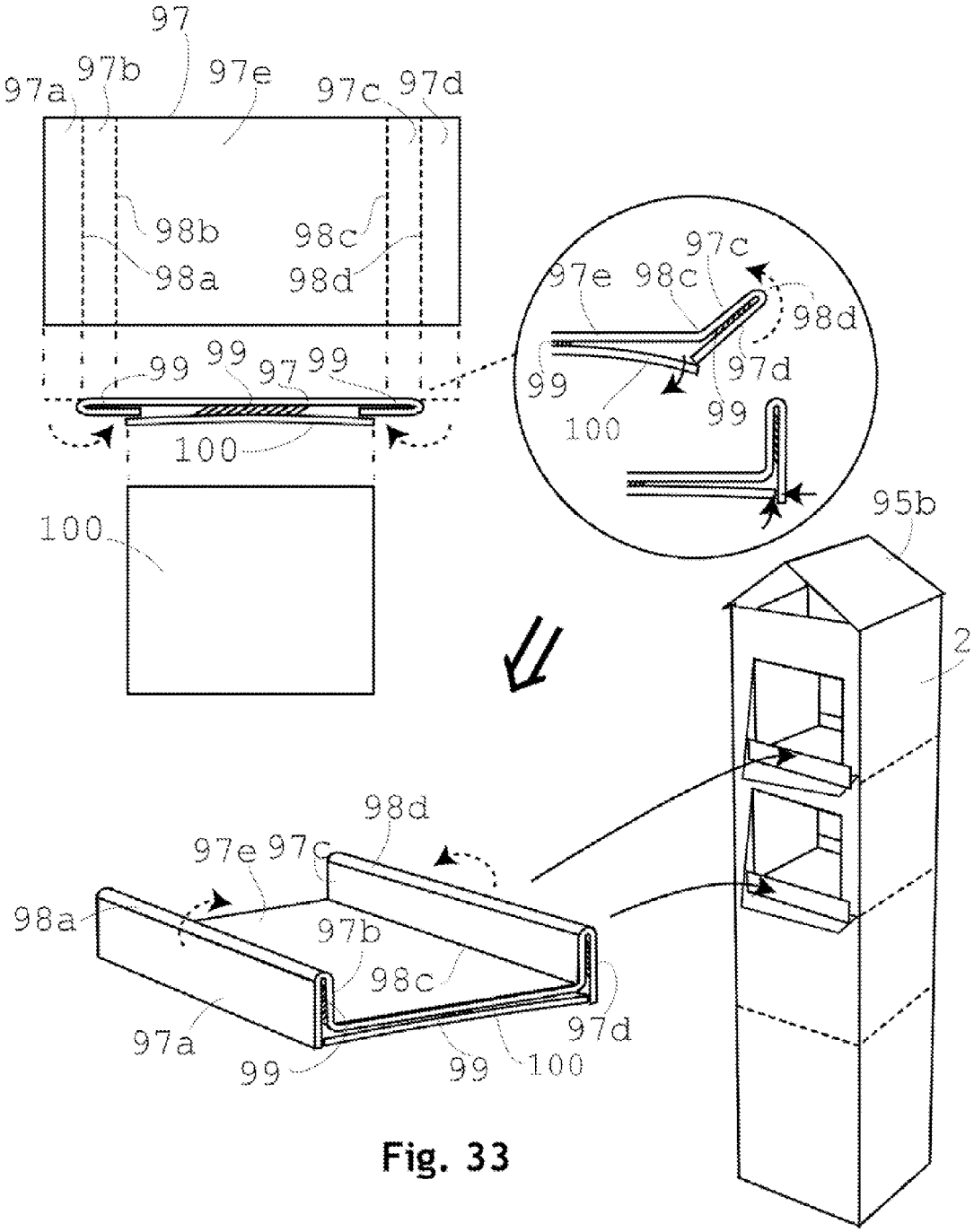
Figures 34A, 34B, 34C, 34D:
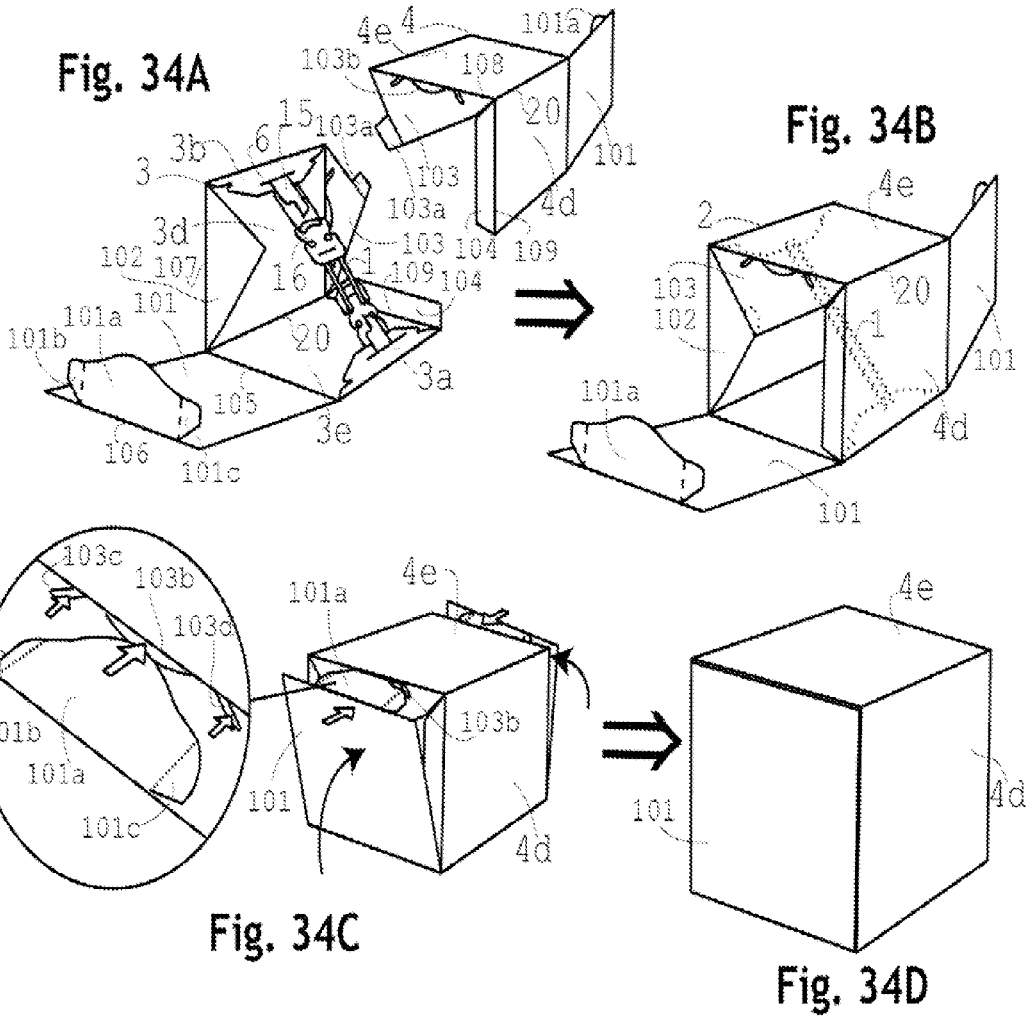
Figure 35A:
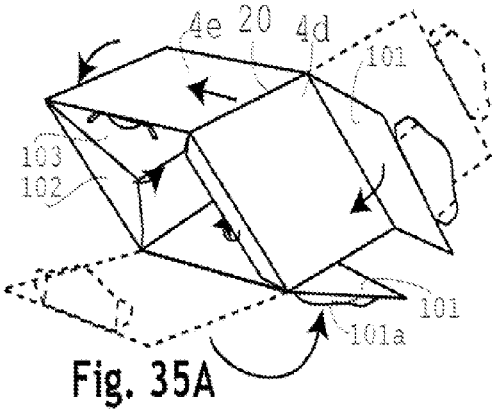
Figure 35B:
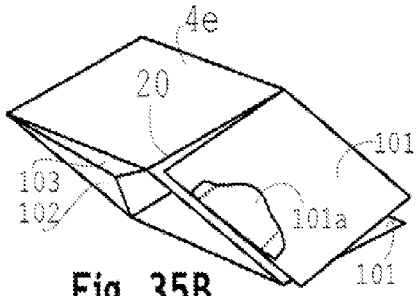
Figure 35C:
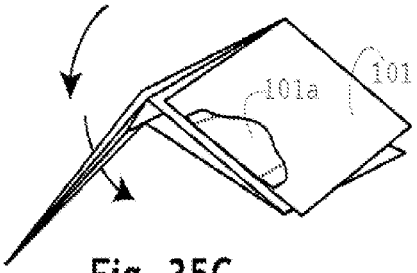
Figure 35D:
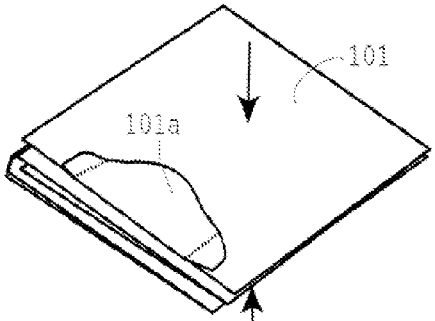

FIGS. 4A and 4B schematically show the application of an extension element of the elastic band having a plurality of couplings for an annular band, based on pairs of open holes. FIG. 4A shows the way of engaging the annular band, and a coupling for the projections of the display, and it shows the two working configurations: the resting configuration (4A) and the extended configuration (4B);

FIG. 5 schematically shows the application of an extension element of the elastic band, a variant of the preceding element as regards the embodiment of the couplings for the elastic band, also based on holes in pairs, and another type of coupling for the projections of the display;

FIG. 6 shows the application of two extensions with a single elastic band;

FIG. 7 schematically shows the use of two elastic bands with a single extension;

FIG. 8 depicts an elastic band consisting of a cord with anchors at the ends which will allow the engaging thereof to the projections of the display;

FIGS. 9, 10, 11 and 12 schematically show applications of the expansion system using extensions of the elastic band;

FIG. 13 schematically shows the application of the expansion system based on an elastic band consisting of a cord;

FIGS. 14A and 14B schematically show a display having a flat face and another convex face in the opposite panel;

FIGS. 15A and 15B depict a rectangular-type display based on two panels each with two vertical creasing lines, equally distributed in both panels;

FIGS. 16A and 16B depict a variant of the preceding display, where the vertical creasing lines of each panel are spaced equidistantly, and giving rise to a square prism;

FIGS. 17A and 17B depict a display which can be considered a variant of the preceding displays where the distances between vertical creasing lines and the expansion system have been adjusted to result in a triangular prismatic structure;

FIGS. 18A and 18B depict a cone-type display which can be obtained by changing the width of the main panels between the upper part and the lower part, based on an oval-type display;

FIGS. 19A and 19B depict a pyramid-type display which can be obtained by changing the width of the main panels between the upper part and the lower part based on a square prism-type display;

FIGS. 20A, 20B, 21A and 21B schematically show structures formed from main panels with non-straight vertical creasings which form irregular curved surfaces when adopting the expanded configuration;

FIGS. 22A and 22B depict a display having two faces with combined flat-oval surfaces. The structure is achieved with main panels having vertical creasings lines and assembling it with the edges formed by folding said creasings outwardly;

FIG. 23 shows a display having main concave surfaces obtained by internally gluing the main panels along an inner vertical line;

FIG. 24 shows a swiveling display as a result of a curved support base for supporting on the floor;

FIG. 25 schematically depicts a display obtained as a result of a plurality of irregular or inclined folds;

FIGS. 26A, 26B, 26C, 27A, 27B and 27C depict variants of counter-type displays formed by a base based on structures such as the preceding displays, and adding an upper board connected by a fastening element. How the assembly can be folded is shown;

FIG. 28 depicts an example of a structure formed as a result of using an arch-like display with hooks performed at the ends, and two column-like displays per se;

FIG. 29 depicts an example of wall, screen- or partition-type structures formed by assembling more than one display along the contiguous side edges thereof;

FIGS. 30A, 30B, 30C and 30D express an embodiment of a leaflet pocket in cooperation with a main panel of the display;

FIGS. 31A and 31B schematically show the application of an anti-tipping platform applied to displays;

FIGS. 32A and 32B explain a method for assembling a panel presented in two parts, without using glue;

FIG. 33 shows how to construct a tray model for product to be inserted into an opening formed in the display intended for such purpose, and;

FIGS. 34A, 34B, 34C, 34D, 35A, 35B, 35C and 35D show, in different steps, a cubic structure, in a particular case a parallelepiped structure, and how the structure can completely folded to the level of a single face.

For the sake of simplicity, most of the drawings show a basic expansion system based only on an annular elastic band, it being understood that the expansion system applied in each case can correspond with any of the variants described in this specification without it changing the essence of each of the described embodiments of the display.

Figure 1A:
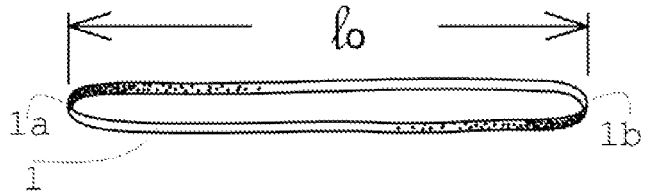
FIGS. 1A and 1B depict an annular-type elastic band, the basic element of the expansion system, showing the two working configurations: the resting configuration (1A) and the extension configuration (1B)
Figure 1B:
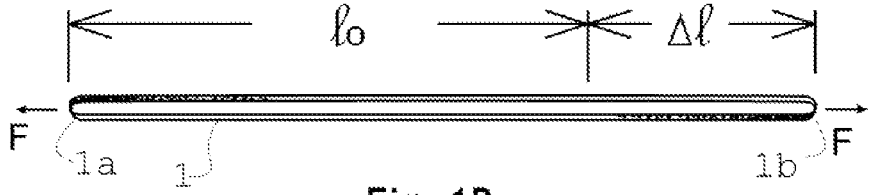
Figure 2A:
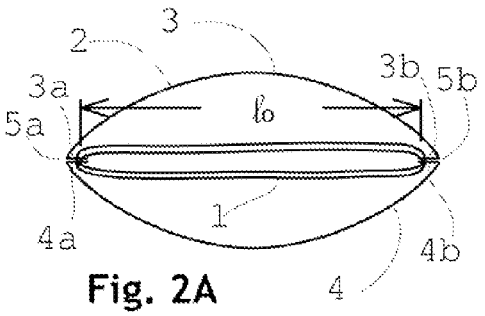
FIGS. 2A and 2B are schematic plan views of the application of the basic expansion system to an oval display, showing the two configurations of the display: the flattened configuration (2B) and the expanded configuration (2A)
Figure 2B:
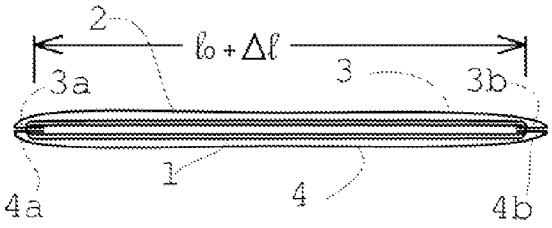
Figure 3A:
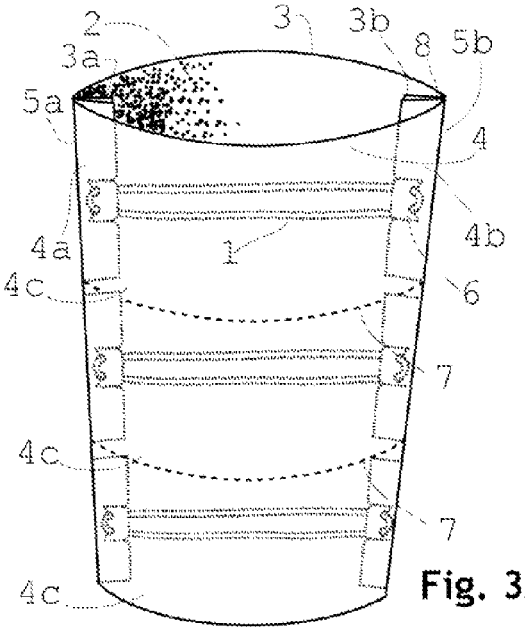
FIGS. 3A and 3B show an oval display in which the basic expansion system is applied in the working position (3A) and in the folded position (3B), using horizontal creasings made in the main panels.
Figure 3B:
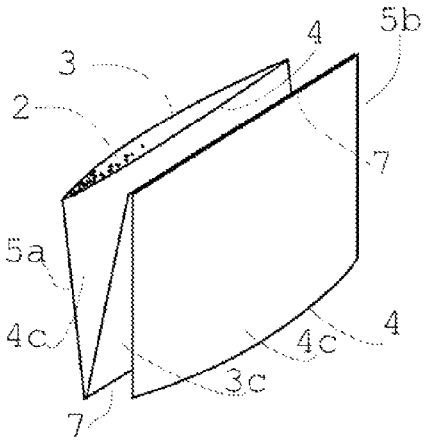

First in relation to FIGS. 1A and 1B, these figures show the expansion system in the most basic form. Reference number -1- designates an elastic band in general. The drawings show the two working positions, the resting position in FIG. 1A and the extended position in FIG. 1B, where the length of the band 1 increases by value ΔL. The band has two ends referred to as -1*a*- and -1*b*-. This first embodiment is important due to its simplicity, being capable by itself to cause the expansion of a display -2- of the type expressed in the field of application, for keeping it in an upright position, as shown in FIG. 3A, applied to a display which can be referred to as a conventional or basic display since it is the most widely used and marketed model. FIGS. 2A and 2B schematically show the way in which the expansion system is applied and the difference between the flattened position in FIG. 2B and the extended position in FIG. 2A. The apparent simplicity of this embodiment of the expansion system must not be confused with simpleness since the characteristics of the elastic band must be calculated and adjusted, as described in this specification, in order to achieve the desired result, a philosophy that has not been used up until now and that has already been demonstrated in the described background. In this embodiment, the elastic band is linked to both inner sides of the display, on inner side projections -3*a*, 3*b*, 4*a*, 4*b*- which are formed by projection of the main panels of said display having hooks or engaging elements -6- in which the elastic band -1- can be engaged or linked.

A second embodiment of the expansion system is shown in FIGS. 4A, 4B, 5, 6 and 7. This embodiment uses an extension element, designated with numbers -10- and -15-, to enable applying the expansion system when requiring lengths much greater than those that could be provided by using only one elastic band -1-. The material forming said extension element -10, 15- does not have to be a rigid element since it only acts as an element for prolonging the elastic band -1-, so the forces to which it is subjected are stretching and not compressive forces. The function of extension element -10, 15- consists of making the elastic expansion system have a greater resting length and allowing it to be adapted to the desired length according to the application where said elastic expansion system will be used. With this system, it is possible to use one and the same elastic band -1- for different types of display, or to adjust the force and elongation characteristics within one and the same type of display based on one and the same type of elastic band.

To facilitate a greater number of adjustments with one and the same extension element -10, 15-, a plurality of couplings means for the elastic band can be formed on said extension element at different distances from the end thereof. Said couplings means are indicated with numbers -11- and -16-, according to the type, and are formed in this example by means of a plurality of substantially circular holes from which corresponding cutting lines reaching the side edge of the part emerge. In FIGS. 4A, 4B, 5, 6 and 7, the couplings means -11- and -16- are distributed in pairs along the substantially rectangular part forming the extension element -10- or -15-. The elastic band -1- is engaged by making it go through both matching holes. It is a rather strong engagement even though the material forming the part is not very tough; generally said material is flexible plastic. In a variant of the preceding couplings means, the couplings means are individual with the elastic band being led through a single hole. This coupling means is not as strong as that described above, but has the advantage of being quicker to handle, which can be important at the production cost level. Said extensions furthermore form a coupling, with numbers -12- and -17- according to the examples, intended for engaging said element with respect to a side edge of the display, which will have the complementary coupling intended for such purpose and will be described in the following section.

Said extension elements -10- or -15- per se do not play an active functional role, but rather complement the functionality of the elastic band -1- and act in cooperation with it. As mentioned in the "Brief Description of the Invention" section, said extensions elements -10, 15- complement and modify the resting length characteristic of the expansion system, allowing material savings and greater versatility in the use of the elastic bands. Generally, the extension element allows modifying the resting length of the expansion system conserving the elastic modulus.

The example shown in FIGS. 6 and 7 shows how extensions -10- or -15- can be applied on both sides of the elastic band -1-, or how two bands can be applied on both sides of one and the same extension element -10, 15-. It is also possible to connect two extensions elements -10, 15- one after the other with coupling means of the type indicated in FIG. 6 with elements -17-, -17*a*- and -17*b*-. The objective is to achieve even greater length using the same basic elements, without the need for having two extension elements -10, 15- of a different size or two types of elastic band, with subsequent production cost savings.

The example shown in FIG. 8 shows a variant of a linear- or cord-type elastic band also generically numbered as -1-. Although functionality is exactly the same as when using annular bands, this system necessarily has auxiliary engaging elements, herein referred to as -18*a*- and -18*b*-, integral with the ends of the band referred to as -1*a*- and -1*b*-. These engaging elements -18*a*- and -18*b*- can be metal clamps, plastic parts, etc., formed like a hook or an anchor to enable fastening the end to the display where it is incorporated.

Figure 9:
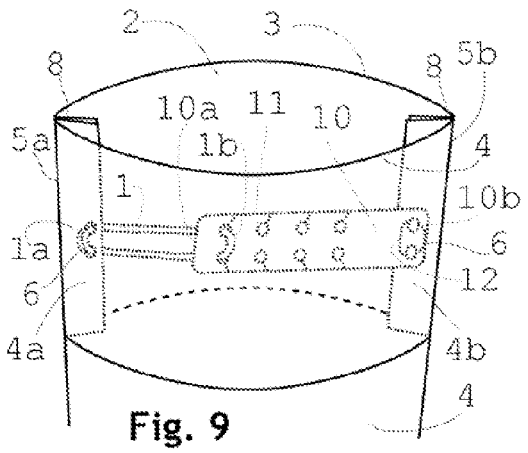
Figure 10:
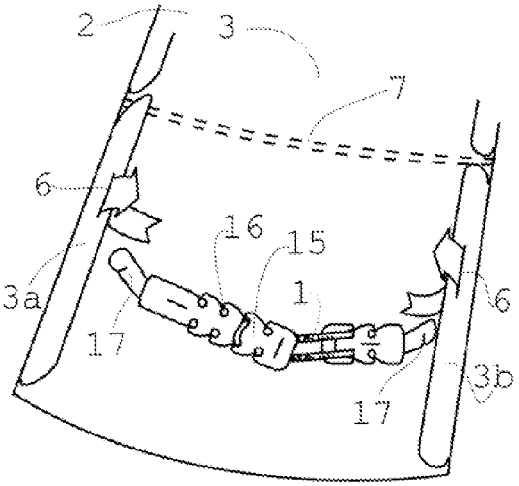
Figure 11:
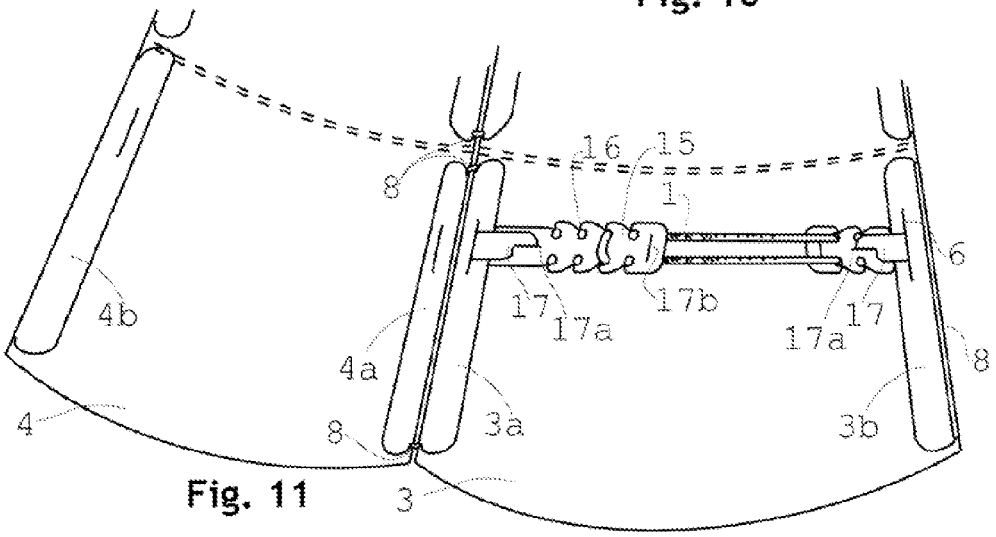
Figure 12:
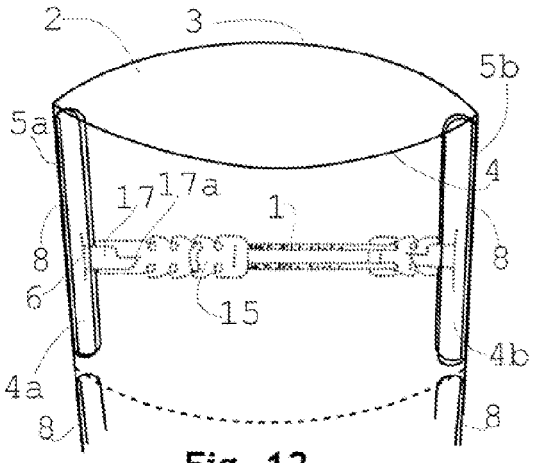

FIGS. 9, 10, 11, 12 and 13 show diagrams of how expansion systems based on extensions of the elastic band via on or more extension elements -10, 15- are applied, as described in the preceding sections, to a basic display, -2-, both with a single extension element -10- in FIG. 9 and with two extension elements -15- in FIGS. 10, 11 and 12. FIG. 13 schematically shows that same display based on an expansion system comprising a cord-type elastic band.

The present patent also provides a display to which any of the embodiments of the expansion system described in the present document can be applied, as schematically shown in FIGS. 2A, 2B, 3A, 3B, 9, 10, 11, 12 and 13. Said display, generically numbered as -2-, consists of two main panels numbered -3- and -4- made of flexible sheet material, generally graphic cardboard or the like, having side projections -3*a*-, -3*b*-, -4*a*- and -4*b*-, differentiated by means of creasing lines in the material, protruding from the sides of said panels like projections, and capable of turning completely over said creasings until they are flattened and arranged facing the inside of the main panels -3- and -4-. Said main panels are arranged opposing one another back to back, internally encompassing the side projections of both panels. The side projections are formed in a symmetrical manner such that the facing projections of both panels overlap one another and match in their outer profile, situation in which a connecting system, such as glue is applied between both projections, the profile being linked by annular elastic bands, clamping, etc., which is generically indicated with number -8- without specifying the detail since it does not change the essential value of the system. Said projections further comprise connecting or engaging means, numbered as -6- or -19-, for connecting or engaging with respect to an elastic band directly, or with respect to an extension which contains the elastic band, as explained above, and which already contains the complementary coupling, numbered as -12- and -17-, or -18*a*- and -18*b*-. Said engaging elements -6- and -19- can be formed by means of one or two holes made in said projections, from which a cut line emerges up to the edge of the projection for defining one or two entry lines, said cut allowing the entry of the elastic band or the hook -12- or -17-, of the extension -10-, -15-, up to the situation of engagement. In the case of a linear band with hooks in the form of an anchor as shown in FIG. 8 with references -18*a*- and -18*b*-, said engaging means of the side projections of the main panels of the display being simply holes, numbered as -19- in FIG. 13, will be enough.

Another embodiment of the display is shown in FIGS. 14A and 14B. This embodiment is characterized in that one of the main panels -4- of the display -2- has two vertical creasing lines indicated as -20-, preferably distributed symmetrically with respect to the vertical direction, which divides said panel -4- into three regions in the form of a column, two of them are indicated as -4*e*- and -4*f*-. Each of said regions can be hinged with respect to the contiguous regions by turning along said creasings -20- when the display is brought to the working or expanded arrangement. Preferably, the creasing lines -20- are equidistantly spaced a short distance from the side edges, relative to the central region, -4*e*- which will occupy most of the surface of the panel -4-, while at the same time the expansion system is adjusted so that the inclination between the side regions -4*d*- and -4*f*- and the central region is approximately a right angle. A structure which has the appearance of a flat surface on the face formed by the panel -4- and forms a substantially cylindrical or oval bulged column surface on the opposite face is thereby defined.

In another embodiment of the display shown in FIGS. 15A, 15B, 16A and 16B, each of the main panels -3- and -4- of the display -2- has a vertical creasing line indicated as -20-. Said creasing lines are placed at the same distance from the side of each panel -3- and -4- as seen from the front. Once the main panels -3- and -4- are arranged facing one another to form the display -2-, the narrowest columns -4*d*- defined in each panel by means of the mentioned vertical creasing are arranged adjacent to opposite sides of the display. When the display adopts the expanded position, said narrowest column regions -4*d*- become the narrowest sides of a prismatic structure. In this embodiment, the expansion system is adjusted such that the two substantially flat regions -4*e*- and -4*d*- of each panel form preferably right angles between adjacent faces, thus obtaining a prismatic structure having a rectangular section, and the widest column regions -4*e*- of each panel become the main widest faces of said structure. Without changing the essence of this same embodiment, locating the vertical creasing -20- right on the vertical axis of each panel -3- and -4- is enough to obtain two column regions of the same width resulting in a prismatic structure having a square section, provided that the expansion system is adjusted so that the faces form substantially right angles, as shown in FIGS. 16A and 16B.

Another embodiment of the display which can be considered a variant of the display described in the preceding paragraph is the one shown in FIGS. 17A and 17B. It is also of a prismatic-type structure but in this case has a triangular section. This display is formed by means of two main panels -3- and -4- having two vertical creasing lines -20- like the preceding example, with the difference that the left column region of the panel -3- is half as wide as the adjacent column, whereas the left column -4*d*- of the panel -4- is twice as wide as the adjacent column. By adjusting the expansion system so that the narrower faces of each panel are aligned and therefore coplanar, a prismatic structure having a substantially isosceles triangular section, as shown in the mentioned drawings, is formed.

The embodiment of the display shown in FIGS. 18A and 18B can be considered a variant of the basic display described in a preceding paragraph in relation to FIGS. 2A, 2B, 3A, 3B, 9, 10, 11, 12 and 13. This embodiment is also formed by two main panels -3- and -4- made of flexible sheet material, however, in this case, said main panels show a greater length along the width of their base than along the width of the upper zone, said width changing proportionally with the distance to the base. When the display -2- expands, the contour of the display takes a substantially conical shape. The cone will be cylindrical or oval depending on the adjustment of the expansion system. Although the drawings show a truncated cone, a complete cone can be constructed without changing the essence of the embodiment.

Another embodiment of the display is shown in FIGS. 19A and 19B. This embodiment can be considered a variant of the display shown in FIGS. 16A and 16B described above in a preceding section corresponding to a square prism-shaped display. In this new embodiment, the main panels -3- and -4- have a central and vertical creasing line indicated as -20- defining two vertical regions in each panel, -4*d*- and -4*e*- in panel -4-, which can turn a certain angle with respect to one another when the display adopts the expanded configuration. In this embodiment, said main panels show greater width along their base than in the upper zone, said width changing proportionally with the distance to the base. When the display -2- expands, the contour of the display adopts a substantially pyramidal shape. The adjustment of the expansion system will once again be a necessary element in order to achieve the desired square profile in this case. Although the drawings show a truncated pyramid, a complete pyramid could be constructed without changing the essence of the embodiment.

Figure 20A:
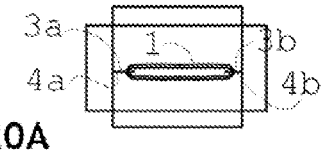
Figure 20B:
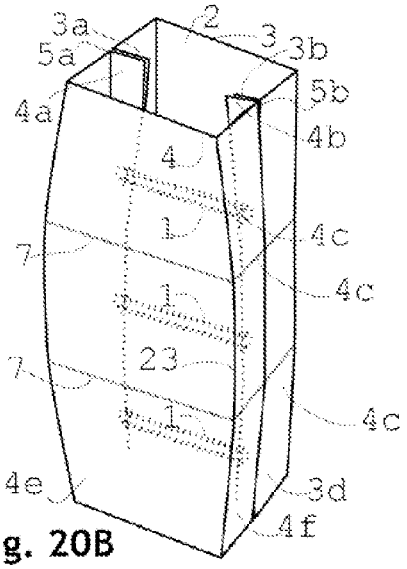
Figure 21A:
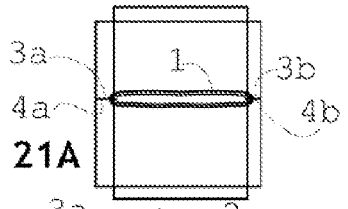
Figure 21B:
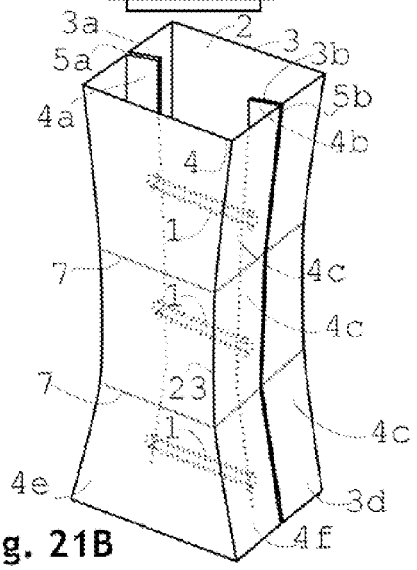

In another embodiment of the display shown in FIGS. 20A, 20B, 21A, and 21B, each main panel -3- and -4- has two vertical creasing lines indicated as -23- with the particularity of forming a broken or curved line, changing the distance of each creasing segment with respect to the closest side edge of the display depending on height, as well as the angle between one creasing segment and another. Each of said panels -3- and -4- is divided into three column regions, some of these indicated as -3*d*-, -4*e*- and -4*f*- having a variable width according to height, said zones being able to be hinged to one another by turning along said creasing -23- when the display adopts the working arrangement, so an irregularly prismatic structure is thereby defined. In addition, the resting length feature of the expansion system is adjusted to a value such that two contiguous column side surfaces of each panel -3- and -4- closest to both ends of the display are coplanar in each horizontal segment, forming a single curved effective surface divided by a central line which is at the same time the line joining the two panels -3- and -4- of the display. Depending on how the curvature of the creasing lines -23- changes, the assembled structure can adopt bulged shapes or shapes with a tapered central zone, as shown in FIGS. 20B and 21B, providing certain originality to the display and making it interesting as a support for an advertising message.

A new embodiment of the display provided in the present patent is schematically shown in FIGS. 22A and 22B, and it comprises main panels -3- and -4- having a vertical creasing -20- dividing each of said panels into two different column regions -3*d*-, -3*e*-, 4*d*- and -4*e*-. Both column regions of each panel -3- and -4- are folded together by turning along said creasing lines -20-, being arranged back to back. The two panels are assembled such that both panels -3- and -4- are arranged opposing one another, maintaining the situation in which the two column surfaces of each panel described above and defined by the creasing -20- are folded with their inner surfaces facing one another. The creasing lines -20- form the outermost edges of the display both in the folded position and in the working position. When adopting the expanded configuration, the display -2- shows two visualization areas, each of which shows two combined faces, one of each panel -3- and -4-, a flat face and another bulged face, as can be seen in FIG. 22B.

Based on a display where each of the main panels -3- and -4- has two vertical creasing lines -20-, the distance of each creasing with respect to the closest side edge of the corresponding panel being the same, and this distance being substantially shorter than the width of the central regions, the corresponding to panel 4 is indicated as -4*e*-, a new embodiment can be provided in which the two said central regions corresponding to the two main panels -3- and -4- have discrete regions for gluing on the facing inner surfaces, numbered as -50-, along a vertical central line to prevent the bulging of said central zones, and to therefore force the bulging of the side zones of the same panels, thereby producing a structure in the form of a column with two concave surfaces in the front and rear zones of the display. The zones for gluing must not prevent the passage of an elastic band through the inner surfaces to enable housing the expansion system. This embodiment is schematically shown in FIG. 23.

FIG. 24 schematically shows another embodiment of the display based on a display shown above, with the characteristic of having a curved cut line on its base, referred to as -51-. This offers certain instability to the working equilibrium of the display in the expanded configuration, meaning that the most minor mechanical perturbation, such as an air stream, can cause a swiveling movement. This display would be useful to draw attention as an advertising message.

A new embodiment of the display is shown in FIG. 25, which, like the preceding displays, also has main panels -3- and -4- having two vertical creasing lines per panel indicated with number -20-, forming a substantially rectangular surface therebetween, whereas the main panels are wider at the base than in the upper line, and furthermore the vertical creasing lines -20- start from the upper vertices and descend in a substantially vertical fashion, furthermore defining substantially triangular side surfaces as that identified as -3*f*- and 4*d*. When the display adopts the expanded configuration, the surfaces turn with respect to one another by means of the folding lines, forming different angles and giving rise to a final structure adopting a tent or gable roof shape, i.e., two substantially rectangular surfaces in the main front and rear visualization areas, and two substantially triangular surfaces on the sides.

Figure 26A:
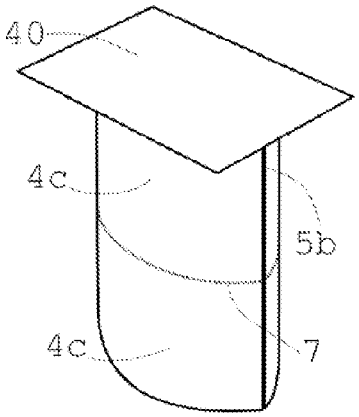
Figure 26B:
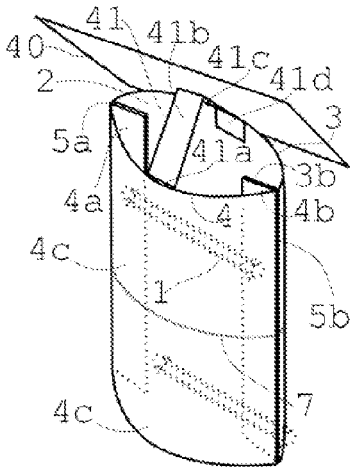
Figure 26C:
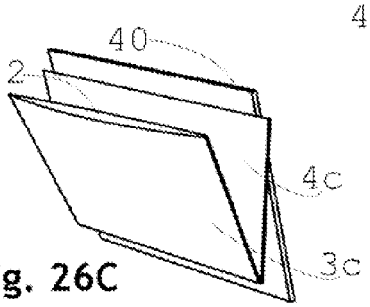

The present invention also provides a type of display capable of supporting products thereon. It is a counter-type display formed basically by a central support column -2-, an upper board numbered as -40-, and a connecting element -41- for connecting said board to said main support. The support column consists of a structure equivalent to any of the previously described displays. FIGS. 26A, 26B and 26C show a specific example of an embodiment where the main column of the counter is formed by a structure which corresponds with the basic display having an oval section described above. The connecting element -41- for connecting the board -40- with the base -2- is formed by a plate made of sheet material such as paperboard or the like having three horizontal creasing lines defining four regions -41*a*-, -41*b*-, -41*c*-, -41*d*- hinged to and differentiated from one another. One of said creasings is located at the center of said plate, and the other two creasings are located a short distance and the same distance from the ends of said plate, defining in the two end regions zones suitable for being glued in the central zones of the upper edge of the main panels of the main column. In the flattened position, the board can turn together with the connecting element on the adjacent flattened body of the base of the counter, which can in turn contain an additional fold and the entire assembly can be in a flattened configuration in the form of an accordion, as shown in FIG. 26C, to achieve greater volume reduction during transport or storage.

Figure 27A:
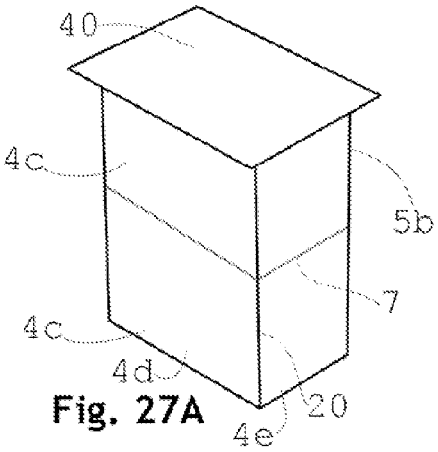
Figure 27B:
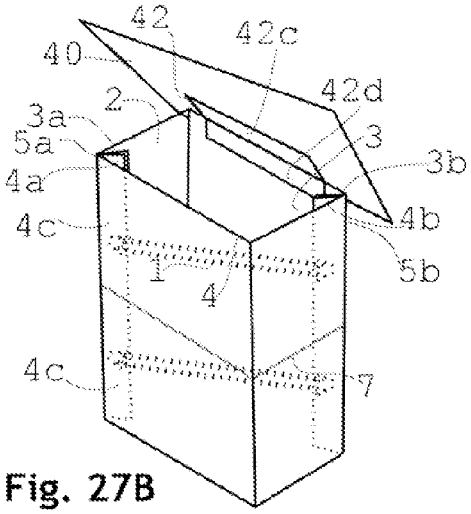
Figure 27C:
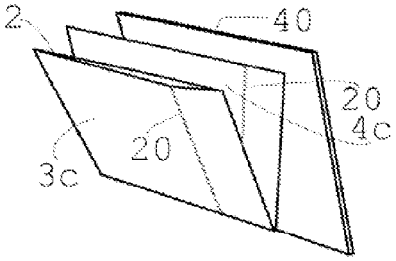

FIGS. 27A, 27B and 27C also show the embodiment of a counter-type display that is completely equivalent to the display described in the preceding paragraph, with the only difference of having changed the oval- or rectangular-type main column with an also rectangular-type main column but formed according to the rectangular display with entire side walls folded laterally forming a rhombus, as described above. In this embodiment, the connecting part for connecting the board to the column can be simply formed by a plate -42- made of rectangular rigid sheet material having two regions -42*c*- and -42*d*- of approximately the same width, hinged to and differentiated from one another, defined by means of a longitudinal creasing, the first zone -42*d*- being susceptible to being glued in the central zone of the upper edge of one of the main panels -3- or -4-.

FIG. 28 shows an embodiment of a coupling system for coupling displays of the type shown until now, which allow forming arch- or goal-type structures. The essential feature in this embodiment consists of a straight, die-cut profile at the ends of the main panels -3- and -4- together with several creasing lines, in prism- or curve-type displays in the case of an oval display, defining substantially rectangular-, triangular- or arch-shaped areas referred to as -80*a*- and -80*b*-, such that by connecting said areas of both main panels -3- and -4- along an connecting fold indicated as -81-, a hook or groove indicated as -82- is formed, at which time the display adopts the working configuration in which it can be coupled to two conventional collaborating displays acting as columns, the first display being supported and coupled on both sides on the upper edge of a main panel of both collaborating displays forming a complete structure in the form of a goal or an arch.

FIG. 29 shows an embodiment of structures formed by displays of the type shown until now, constructed by means of assembling more than one display based on connecting side edges thereof by means of elastic bands linked to the side projections of the main panels. A flat panel assembled using the same method could be intercalated between two consecutive displays for the purpose of increasing the exposure surface indicated with -87-.

Any of the displays described as embodiments can have a series of horizontal creasing lines generally numbered as -7- along which it can be folded in the form of an accordion to occupy less volume in the flattened position, as shown throughout most of the drawings depicting the described examples.

Figure 30A:
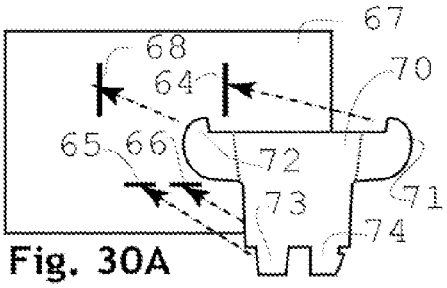
Figure 30B:
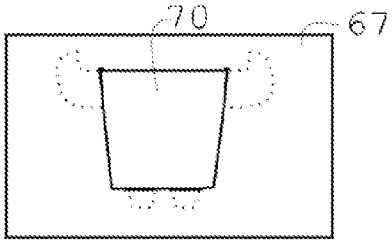
Figure 30C:
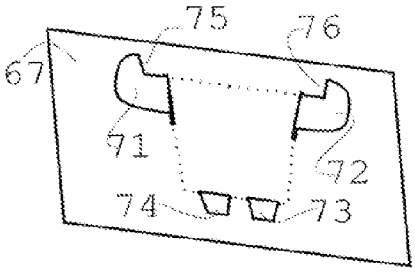
Figure 30D:
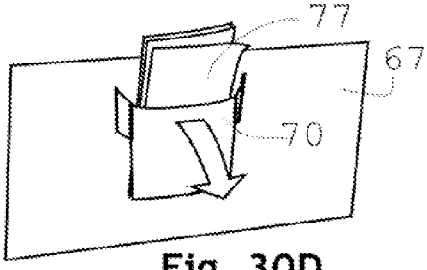

The present invention also provides an embodiment of a minimalist bag system applied to one of the described displays for housing advertising leaflets and serving as a leaflet dispenser. It is based on a panel -70- made of semi-flexible material which can be of the same type as that forming the display itself, having four projections -71-, -72-, -73- and -74-, symmetrical along a vertical axis, which are introduced through grooves or cuts -68-, -64-, -65- and -66- performed in a region of one of the panels -3- or -4- of the display, as schematically shown in FIGS. 30A, 30B, 30C and 30D. The assembly is interlocked and remains flattened until the user lightly pulls on the central zone of the part -70- giving it a bulged shape forming a housing capable of holding a set of advertising or informative leaflets -77-, which is depicted in FIG. 30D; and is also characterized in that an edge -75- and -76- is formed in each of the upper projections -71- and -72- of said part -70-, which edge will act as a stop on the rear part of the main panel, preventing the part from being completely removed when the user pulls on same in order to form it.

Furthermore, FIGS. 31A and 31B show an embodiment of the display having an anti-tipping platform to give stability to said display. It has two symmetrical elements numbered as -90-, formed by substantially rigid, corrugated paperboard-type, sheet material, placed on both sides of the display together with the facing side projections -3*a*-, -3*b*-, -4*a*- and -4*b*- of the main panels -3- and -4-, coupled by means of elastic bands or by means of gluing, each of them formed by two substantially rectangular or polygonal hinged regions -90*a*- and -90*b*- hinged by means of a vertical fulcrum line indicated as -91-, where the first region indicated by -90*a*- is housed in coplanar form between said side projection of the main panel -3*a*- and -3*b*- and the same panel -3- and -4-, the fulcrum line corresponding in parallel with the inside of the side edge of the display -5*a*- or -5*b*-, whereas the second region -90*b*- extends towards the inside of the display a certain length equivalent to the width thereof; said region -90*b*- furthermore has a hole or hook indicated as -90*c*- close to the lower edge, capable of fastening or linking with an elastic band -92-; and it also comprises a rigid platform-like third part numbered as -93- having two hooks -93*a*- and -93*b*- die-cut therein for the same elastic band which is linked with the second region of the aforementioned elements, said platform being pressed against the base of the display as a result of the tension of the elastic elements. The assembled assembly is perfectly hinged with the display both in the flat and extended positions in which it provides stability and anti-tipping support for the display.

Furthermore, FIGS. 32A and 32B show the embodiment of a system for assembling panel parts for the display based on the expansion system. The main panels of the display are often provided as two separate parts indicated as -3*g*- and -3*h*- that must be connected to one another, for which the upper part -3*g*- has in the lower line thereof regularly distributed projections indicated as -3*i*- narrowing slightly towards the lower end, where the two end projections are narrow enough and are included in the side projection portion of the corresponding panel. In addition, the second part -3*h*- has cuts-grooves indicated as -3*j*-, each of them corresponding with a projection of the first part, and said projections of the first part furthermore fit perfectly with the grooves of the second part along a straight stop line. Elastic bands numbered as -94- connected to the side projections allow the stability and fastening of the assembly.

Finally, an embodiment of a tray for a product which, once formed, can be inserted into an opening formed in the display intended for such purpose is also provided. Said tray is formed from a substantially rectangular flat panel indicated as -97- in FIG. 33, generally made of a paperboard-type material similar to that forming the display, divided into five regions referred to as -97*a*-, -97*b*-, -97*c*-, -97*d*- and -97*e*- defined by folding lines -98*a*-, -98*b*-, -98*c*- and -98*d*-. Regions -97*b*- and -97*c*- are glued to and flattened against the region -97*e*-. An integral rectangular panel indicated as -100- is also added, gluing it along the central region -97*e*- on the same face as those previously glued. The end user must fold the end regions towards the inside of the assembly up to an angle greater than 90° so that the ends of the panel -100- interlock behind regions -97*a*- and -97*d*-, keeping said regions at a fixed angle of about 90°. The effect is achieved as a result of certain flexibility of the panel -100-, allowing it to give way until the end of regions -97*a*- and -97*d*- are allowed to adopt the working position, in which the position is fixed.

Another embodiment of the display is depicted in FIGS. 34A, 34B, 34C, 34D, 35A, 35B, 35C and 35D. It is based on a rectangular prismatic-type display such as those described above in which there have been incorporated regions obtained by the projection of the ends of the main panels for forming covers closing said ends to achieve a parallelepiped, and particularly cubic, structure. In this embodiment, each of the two main panels -3- and -4- has side projections at the free ends of regions -3*d*-, -3*e*-, -4*d*- and -4*e*-, defined by means of folding lines indicated as -105-, -106-, -107-, -108- and -109-, defining, in addition to the two main faces -3*d*-, -3*e*-, -4*d*- and -4*e*- of each panel -3- and -4-, several regions indicated as -101-, -101*a*-, -102-, -103-, -103*a*- and -104- susceptible to being folded towards the inside of the display. One of said regions indicated as -101- and defined by the folding line -105- forms a cover for the prism formed by the basic display for the purpose of closing it at its open ends, for which purpose said region is aided by a projection indicated as -101*a*-, with two regions indicated as -101*b*- and -101*c*- by way of a tab system for final closure, the tab being inserted through a system of grooves -103*b*-, -103*c*-, -103*d*-, located in the contiguous region -103-. This system of projections is connected in a relatively irreversible manner inside the system of grooves and prevents accidental opening of the structure. Another two of said end regions -102- and -103- defined by folding lines -107- and -108- located at opposite ends of one of the main faces -3*d*- and -4*e*- have a substantially triangular shape and one of these two furthermore has a tab -103*a*- or coupling system for coupling with the opposite region -102- in the assembly position. Preferably, at least one tab-like region indicated as -104- having a substantially rhombus shape is also incorporated, hinged along line -109- to act as a rib and provide rigidity to the corresponding edge of the contiguous face -3*e*- and -4*d*- of the display. The depicted display assembly is furthermore susceptible to being folded entirely to the level consisting of a single face (FIGS. 35A, 35B, 35C and 35D), first folding the side covers -101-, folding them backwards, flattening the rest until it is folded to the level consisting of two faces of the parallelepiped, and finally folding along the central line -20- separating two faces until being at a level of folding consisting of a single face, where all the mentioned regions of the main panels are folded and overlapping one another.

Although the invention has been described with respect to preferred embodiments, they must not be considered as limiting of the invention which will be defined by the broadest interpretation of the following claims.

The invention claimed is:

1. An advertising display comprising:

at least two panels made of sheet material, having side projections connected thereto on hinge or folding lines performed in said panels;

an expansion system for bringing said display from a flattened position to an expanded or working position, the expansion system comprising at least one traction elastic band;

hooks or engaging elements for connecting said side projections with said expansion system, said expansion system being mounted directly between said hooks or engaging elements of one of said side projections and said hook or engaging elements of the side projections opposite thereto, said display lacking additional limiting devices defining a stop relative to contraction travel of said at least one traction elastic band, such that an end of the contraction travel of said at least one traction elastic band is defined by a reduction of a contraction force of said at least one traction elastic band during contraction, said expansion system comprising at least one extension element, said at least one extension element comprising a coupling means for said at least one traction elastic band at one end and connecting means at another end thereof for connecting to said side projections of said display, said at least one extension element comprising a plurality of coupling means for said at least one traction elastic band, located at different points of said at least one extension element for defining different lengths of said expansion system.

2. An advertising display according to claim 1, wherein dimensions of said display in the expanded or working position are determined by a resting length characteristic of said at least one traction elastic band.

3. An advertising display according to claim 1, wherein said at least one traction elastic band is hung from two ends, being supported at points in which said at least one traction elastic band is hung and without any support or guide in at least one intermediate part between supports.

4. An advertising display according to claim 1, wherein said expansion system comprises another traction elastic band to provide two elastic bands connected to one another through said at least one extension element between said two elastic bands having at least one of said plurality of coupling means for each of said two elastic bands at each end of said at least one extension element.

5. An advertising display according to claim 4, wherein said at least two panels are two message display panels, said two message display panels being of a same width, made of flexible sheet material, said plurality of side projections being connected thereto on said hinge or folding lines performed in said display panels by creasing said hinge or folding lines in the sheet material of said display panels, such that when said side projections are folded inwardly by means of said hinge or folding lines, side edges are formed in the display, and the display further comprising:

another connecting means provided between opposite side projections of the display panels of the display for keeping said opposite side projections connected to one another;

engaging means in said side projections such that said elastic bands of said expansion system or the at least one extension element are to be linked through said connecting means of said extension elements, or the engaging elements.

6. An advertising display according to claim 5, wherein said another connecting means comprises one of glue and elastic bands.

7. An advertising display according to claim 1, wherein said at least one extension element is made of flexible plastic.

8. An advertising display according to claim 1, wherein said at least one traction elastic band is an annular type of elastic band.

9. An advertising display according to claim 1, wherein said at least one traction elastic band is a linear type of elastic band with two opposite ends, and each of said opposite ends is integrally connected to one of said hooks or engaging elements made of metal, plastic or another material, and said engaging elements allowing said ends of the at least one traction elastic band to be engaged to said side projections of said display.

10. An advertising display according to claim 1, wherein said at least two panels have a plurality of horizontal lines formed by creasing lines dividing each of said at least two panels into substantially rectangular portions, allowing said at least two panels to be fold along said horizontal lines when the display is compressed to said flattened position to provide a smaller folded assembly.

11. An advertising display according to claim 1, wherein two symmetrical elements made of substantially rigid, corrugated paperboard-type sheet material, are coupled by means of said at least one traction elastic band and at least another traction elastic band or by means of gluing to facing side projections of the at least two panels corresponding to a lower zone of said display, on both sides of said display, each of said two symmetrical elements being formed by two substantially rectangular or polygonal hinged regions hinged by means of a vertical fulcrum line, where a first region is housed in coplanar form between said side projection of one of said at least two panels and another one of said at least two panels, said fulcrum line being parallel corresponding with an inside of one of said side edges of the display, wherein a second region extends towards the inside of said display a certain length equivalent to a width thereof, said second region further comprising a hole or hook close to a lower edge thereof for fastening or linking an elastic band, the display further comprising:

a rigid platform-like third part having die-cut therein, two hooks for said elastic band which is linked to the second region of said two symmetrical elements, said rigid platform-like third part being pressed against a base of the display as a result of tension of said elastic band.

12. An advertising display according to claim 1, wherein said at least two panels of the display are provided as two separate parts that are connected to one another, for which a first part of the two separate parts has in a lower line thereof regularly distributed projections narrowing slightly towards a lower end, where two of said regularly distributed projections are narrow enough and are included in a side projection portion of a corresponding panel, wherein a second part of the two separate parts has cuts-grooves, each of said cuts-grooves corresponding to a projection of the first part, said projections of the first part fitting with the cuts-grooves of the second part along a straight stop, wherein elastic bands hold to the side projections to provide stability and fastening of the assembly.

13. An advertising display according to claim 1, further comprising:

a substantially rectangular flat panel comprising a cardboard-type material, divided into five regions defined by folding lines, and an integral rectangular panel, said substantially rectangular flat panel being formed by placing glue in two alternating regions of said five regions, adjacent to a central region of the five regions and folding along the folding lines until the glue comes into contact with the central region, the integral rectangular panel being added by gluing along the central region on a previously used gluing face.

14. An advertising display comprising:

at least two panels made of sheet material, having side projections connected thereto on hinge or folding lines performed in said panels;

an expansion system for bringing said display from a flattened position to an expanded or working position, the expansion system comprising at least one traction elastic band;

hooks or engaging elements for connecting said side projections with said expansion system, said expansion system being mounted directly between said hooks or engaging elements of one of said side projections and said hook or engaging elements of the side projections opposite thereto, said display lacking additional limiting devices defining a stop relative to contraction travel of said at least one traction elastic band, such that an end of the contraction travel of said at least one traction elastic band is defined by a reduction of a contraction force of said at least one traction elastic band during contraction, wherein two symmetrical elements made of substantially rigid, corrugated paperboard-type sheet material, are coupled by means of said at least one traction elastic band and at least another traction elastic band or by means of gluing to facing side projections of the at least two panels corresponding to a lower zone of said display, on both sides of said display, each of said two symmetrical elements being formed by two substantially rectangular or polygonal hinged regions hinged by means of a vertical fulcrum line, where a first region is housed in coplanar form between said side projection of one of said at least two panels and another one of said at least two panels, said fulcrum line being parallel corresponding with an inside of one of said side edges of the display, wherein a second region extends towards the inside of said display a certain length equivalent to a width thereof, said second region further comprising a hole or hook close to a lower edge thereof for fastening or linking an elastic band; and a rigid platform-like third part having die-cut therein, two hooks for said elastic band which is linked to the second region of said two symmetrical elements, said rigid platform-like third part being pressed against a base of the display as a result of tension of said elastic band.

15. An advertising display comprising:

at least two panels made of sheet material, having side projections connected thereto on hinge or folding lines performed in said panels;

an expansion system for bringing said display from a flattened position to an expanded or working position, the expansion system comprising at least one traction elastic band; and hooks or engaging elements for connecting said side projections with said expansion system, said expansion system being mounted directly between said hooks or engaging elements of one of said side projections and said hook or engaging elements of the side projections opposite thereto, said display lacking additional limiting devices defining a stop relative to contraction travel of said at least one traction elastic band, such that an end of the contraction travel of said at least one traction elastic band is defined by a reduction of a contraction force of said at least one traction elastic band during contraction, wherein said at least two panels of the display are provided as two separate parts that are connected to one another, for which a first part of the two separate parts has in a lower line thereof regularly distributed projections narrowing slightly towards a lower end, where two of said regularly distributed projections are narrow enough and are included in a side projection portion of a corresponding panel, wherein a second part of the two separate parts has cuts-grooves, each of said cuts-grooves corresponding to a projection of the first part, said projections of the first part fitting with the cuts-grooves of the second part along a straight stop, wherein elastic bands hold to the side projections to provide stability and fastening of the assembly.

16. An advertising display comprising:

at least two panels made of sheet material, having side projections connected thereto on hinge or folding lines performed in said panels;

an expansion system for bringing said display from a flattened position to an expanded or working position, the expansion system comprising at least one traction elastic band;

hooks or engaging elements for connecting said side projections with said expansion system, said expansion system being mounted directly between said hooks or engaging elements of one of said side projections and said hook or engaging elements of the side projections opposite thereto, said display lacking additional limiting devices defining a stop relative to contraction travel of said at least one traction elastic band, such that an end of the contraction travel of said at least one traction elastic band is defined by a reduction of a contraction force of said at least one traction elastic band during contraction; and a substantially rectangular flat panel comprising a cardboard-type material, divided into five regions defined by folding lines, and an integral rectangular panel, said substantially rectangular flat panel being formed by placing glue in two alternating regions of said five regions, adjacent to a central region of the five regions and folding along the folding lines until the glue comes into contact with the central region, the integral rectangular panel being added by gluing along the central region on a previously used gluing face.

* * * * *